US008141536B2

(12) United States Patent
Tsunoda

(10) Patent No.: US 8,141,536 B2
(45) Date of Patent: Mar. 27, 2012

(54) AIR CLEANER FOR STRATIFIED-SCAVENGING TWO-STROKE INTERNAL COMBUSTION ENGINE

(75) Inventor: Hidekazu Tsunoda, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 502 days.

(21) Appl. No.: 12/361,662

(22) Filed: Jan. 29, 2009

(65) Prior Publication Data

US 2009/0283079 A1 Nov. 19, 2009

(30) Foreign Application Priority Data

Feb. 4, 2008 (JP) ..... 2008-24065

(51) Int. Cl.
*F02B 77/00* (2006.01)

(52) U.S. Cl. ..... 123/198 E; 123/65 R; 55/383

(58) Field of Classification Search ..... 123/65 PD, 123/198 E, 73 C, 73 AA, 74 A, 65 A, 65 P, 123/73 A, 579, 73 PP; 55/385.3, 318, 462–465
See application file for complete search history.

(56) References Cited

U.S. PATENT DOCUMENTS 4,098,248 A * 7/1978 Todd ..... 123/527
4,600,418 A * 7/1986 Gommel et al. ..... 55/462
5,503,649 A * 4/1996 Nickel ..... 55/321
5,582,146 A * 12/1996 Linsbauer et al. ..... 123/198 E
5,706,777 A * 1/1998 Schlessmann et al. ... 123/198 E
6,857,402 B2 2/2005 Schlossarczyk et al.
7,228,825 B2 6/2007 Hoche et al.
2008/0120951 A1* 5/2008 Sato et al. ..... 55/418

FOREIGN PATENT DOCUMENTS

JP 2000-170611 6/2000
JP 2001055958 A * 2/2001

* cited by examiner

*Primary Examiner* — Michael Cuff
*Assistant Examiner* — Hung Q Nguyen
(74) *Attorney, Agent, or Firm* — Kilyk & Bowersox, P.L.L.C.

(57) ABSTRACT

Object
It is intended to prevent intrusion of air-fuel mixture into an air cleaner by blow-back in an air-fuel mixture passage of a stratified-scavenging two-stroke engine.
Solution
The air cleaner (24) includes a guide member (30). A blow-back flow of air (20) flowing back to the air cleaner (24) through a first air opening (23A) due to blow-back of air is induced to a vicinity of a second air opening (23M) by the guide member (30). A blow-back flow of air-fuel mixture (21) occurring in an air-fuel mixture passage (2) prior to the blow-back phenomenon in an air passage (3) collides the air flow 20 moving toward the vicinity of the second air opening (23M), and retains the air-fuel mixture near the second air opening (23M).

9 Claims, 41 Drawing Sheets

AIR CLEANER FOR STRATIFIED-SCAVENGING TWO-STROKE INTERNAL COMBUSTION ENGINE

FIELD OF THE INVENTION

The present invention relates to an air cleaner for a stratified-scavenging two-stroke internal combustion engine.

BACKGROUND OF THE INVENTION

Compact two-stroke internal combustion engines have been used as a power source of portable power working machines such as brush cutters, chain saws or the like. Two-stroke internal combustion engines used in portable power working machines are driven at a very high revolution speed as much as near 10,000 rpm or ten plus some thousands rpm in normal revolution.

Compact two-stroke internal combustion engines generally have cylinder-port designs. In these two-stroke engines having such a cylinder-port design, air-fuel mixture ports and exhaust ports are formed in a sidewall of a cylinder, and opened or closed by a sidewall of a reciprocating piston. That is, cylinder port type two-stroke engines have no valve mechanisms dedicated to controlling intake and exhaust functions. Without complex valve mechanisms, cylinder port type two-stroke are made up of a reduced number of parts and so much reduced in weight. Therefore, they are suitable for use as compact power sources of portable power working machines.

Two-stroke internal combustion engines used as a power source in portable power working machines have crankcase compression designs. In engines having a crankcase compression design, air-fuel mixture is introduced into a closed internal space of a crankcase, i.e. a crank chamber, and the air-fuel mixture is pre-compressed by a descending movement of the piston. More specifically, when the crankcase is sealed and the piston moves up, the crank chamber is reduced in pressure to a vacuum. Using this vacuum, air-fuel mixture is next introduced into the crank chamber. Thereafter, in an expansion stroke where the piston moves down, the air-fuel mixture now existing in the crank chamber is pre-compressed by the descending piston, and it is injected into the combustion chamber at near the bottom dead center. The air-fuel mixture injected into the combustion chamber is utilized as a scavenging flow to force out any exhaust gas existing in the combustion chamber through the exhaust ports.

Because two-stroke internal combustion engines use fresh air-fuel mixture to scavenge the combustion chamber, they involve the problem of the so-called "blow-by" in which a part of fresh air-fuel mixture, not having burnt, is forced out together with the burnt gas.

Since the "blow-by" of air-fuel mixture is the phenomenon of undesired external discharge of fresh air-fuel mixture, it not only decreases the fuel efficiency but also increases harmful elements (such as HC, CO, etc.) in the exhaust gas discharged through the exhaust ports.

Stratified scavenging has been proposed as one of techniques for alleviating the "blow-by" of air-fuel mixture (Patent Documents 1, 2 and 3). The "stratified scavenging" is called "initial scavenging by air" as well.

With reference to FIG. 1, the intake system of a stratified-scavenging two-stroke internal combustion engine 1 includes an air-fuel mixture passage (MIX passage) 2, through which air-fuel mixture generated by a carburetor flows, and an air passage (AIR passage), through which fuel-free air containing no fuel flows. The air-fuel mixture passage 2 is in communication with the crank chamber 5 via an air-fuel mixture port 4. The air passage 3 is in communication with a cylinder wall air opening 6 formed in the cylinder wall, in case of an in-piston passage design, for example. This air passage 3 further communicates with a scavenging channel 8 via an in-piston passage 7. The scavenging channel 8 communicates with the combustion chamber 10 through a scavenging window 9 covered and uncovered by the sidewall of the piston P, and communicates with the crank chamber 5 through an air-fuel mixture feed port 11. Reference numeral 12 in FIG. 1 denotes an ignition plug.

In the stratified-scavenging engine, fuel-free air is introduced into the scavenging channel 8 through the air passage 3 by making use of the vacuum created in the crank chamber 5 by upward movement of the piston P. Subsequently, just after the exhaust port 12 is uncovered by downward movement of the piston P, the scavenging window 9 opens, and scavenging takes place. In the scavenging stroke, fuel-fee air in the scavenging channel 8 is first forced out into the combustion chamber 10 through the scavenging window 9 under a pressure in the crank chamber 5, and air-fuel mixture pre-compressed in the crank chamber 5 is next forced out. Thus, the combustion chamber 10 is stratified-scavenged.

Two-stroke internal combustion engines involve the problem of "blow-back" in addition to the problem of "blow-by". The blow-back occurs even when the air-fuel mixture port 4 has a reed valve, Engines of crankcase compression designs introduce a fresh air-fuel charge into the crank chamber 5 by displacement of the piston P as explained above, and the fresh charge is pre-compressed in the crank chamber 5. That is, induction of a fresh charge of air-fuel mixture into the crank chamber 5 takes place in the upstroke of the piston P, and the charge is pre-compressed in the crank chamber 5 in the downstroke of the piston P.

In piston valve designs, i.e. piston-controlled designs, when the piston P moves to near the top dead center, the air-fuel mixture port 4 opens and allows the crank chamber 5 to communicate with the air-fuel mixture passage 2 to introduce a charge of air-fuel mixture into the crank chamber 5. In this configuration, the air-fuel mixture enters into the crank chamber 5 from the air-fuel mixture passage 2 in the upstroke of the piston P to the top dead center. In the next expansion stroke, however, in which the piston P moves down, an increase of pressure in the crank chamber 5 due to the downward movement of the piston 5 causes blow-back of the air-fuel mixture from the crank chamber 5 to the air-fuel mixture passage 2. In reed valve designs using a reed valve (not shown) in the air-fuel mixture port 4, the reed valve exhibits a shutting behavior as the pressure in the crank chamber 5 rises in the process of descending movement of the piston P from the top dead center, and the shutting behavior of the reed valve invites blow-back of the air-fuel mixture to the air-fuel mixture passage 2. Blow-back of air-fuel mixture becomes more notable as the engine revolution increases, and here occurs the problem that fuel components and oil components in the air-fuel mixture, which flows back down to an air cleaner, pollute the air cleaner elements.

Japanese Patent Laid-open Publications Nos. 2000-170611 and 2006-144798 deal with the problem that a flow of air-fuel mixture having entered into the air cleaner by blow-back intrudes into the air passage, and partition the interior space of the air cleaner into two chambers such that the air-fuel mixture passage and the air passage open to different ones of these chambers.

Patent Document 1: U.S. Pat. No. 6,857,402

Patent Document 2: Japanese Patent Laid-open Publication No. 2000-170611

Patent Document 3: Japanese Patent Laid-open Publication No. 2006-144798

SUMMARY OF THE INVENTION

Problems to be Solved by the Invention

FIG. 2 is a diagram for explaining blow-back of air-fuel mixture and blow-back of fuel-free air that occur in a downstroke of a piston P in a stratified-scavenging two-stroke internal combustion engine having a crankcase compression design.

For the purpose of introducing air-fuel mixture into the crank chamber 5, the air-fuel mixture passage 2 is uncovered to communicate with the crank chamber 5 when the piston P reaches near the top dead center as explained above. Therefore, in the process of upstroke movement of the piston P toward the top dead center, the crank chamber 5 is lowered in pressure to a negative value, and air-fuel mixture rushes into the crank chamber 5 from the air-fuel mixture passage 2. In the next expansion stroke, in which the piston P moves down from the top dead center, there occurs a back flow of the air-fuel mixture from the crank chamber 5 to the air-fuel mixture passage 2. Even in reed valve type engines in which a reed valve can close the air-fuel mixture, once the pressure in the crank chamber 5 increases with downward movement of the piston P in the expansion stroke, the pressure in the crank chamber 5 causes rise to shutting motions of the read valve. The shutting motions of the reed valve gives rise to the phenomenon of back flow of the air-fuel mixture to the air-fuel mixture passage 2. This back flow phenomenon in the air-fuel mixture passage 2 is the "blow-back of air-fuel mixture".

In order to introduce fuel-free air from the air passage 3 to the scavenging channel 8, the air passage 3 and the scavenging channel 8 are allowed to communicate with each other when the piston P is in a mid region between the top dead center and the bottom dead center. Therefore, in the process of upstroke movement of the piston P toward the top dead center, the crank chamber 5 in communication with the scavenging channel 8 is lowered in pressure to a negative value, and fuel-free air rushes into the crank chamber 5 from the air passage 3. However, in the process of downward movement of the piston P from the top dead center, the downward movement of the piston P increases the inner pressure of the crank chamber 5, and gives rise to a back flow phenomenon of the fuel-free air from the scavenging channel 8 to the air passage 3 (FIG. 2). This is the "blow-back of air". The blow-back of air and the blow-back of air-fuel mixture explained above become notable in a high revolution range of engines. As shown in FIGS. 2 and 3, the blow-back of air 20 occurs immediately after the blow-back of air-fuel mixture 21. In FIG. 3, reference numeral 22 denotes a carburetor, 23 an air cleaner, 24 an air cleaner element, and 25 a fuel tank.

Remarking such blow-back of air occurring in air passages of stratified-scavenging two-stroke engines, the Inventor of the present invention has reached the present invention. It is therefore an object of the present invention is to provide an air cleaner for a stratified-scavenging two-stroke engine, which makes use of blow-back of air to alleviate contamination of an air cleaner element by blow-back of air-fuel mixture.

Means for Solution of the Problems

According to the present invention, the said problems are solved by providing an air cleaner to be removably attached to a stratified-scavenging two-stroke internal combustion gasoline engine having:

a scavenging window formed into an inner wall of a cylinder;

a scavenging channel making communication between said scavenging window and a crank chamber;

an exhaust port formed into the inner wall of the cylinder;

an air passage communicating with said scavenging channel and feeding the scavenging channel with fuel-free air; and an air-fuel mixture passage for feeding the crank chamber with air-fuel mixture, wherein the air-fuel mixture in said crank chamber is precompressed by a descending movement of a piston in an expansion stroke thereof, and the fuel-free air is forced into a combustion chamber through said scavenging window in a scavenging stroke to stratified-scavenge the combustion chamber, wherein the air cleaner comprises:

an air cleaner element for cleaning air;

a first air opening for supplying said air passage of the engine with air cleaned by said air cleaner element;

a second air opening for supplying said air-fuel mixture passage of the engine with air cleaned by said air cleaner element: and a guide member for guiding the fuel-free air flowing out of the first air opening to a vicinity of the second air opening.

As explained in the foregoing chapter, stratified-scavenging two-stroke engines are subjected to not only blow-back of air-fuel mixture but also blow-back of fuel-free air. Blow-back of fuel-free air 20 occurs just after blow-back of air-fuel mixture 21 (see FIGS. 2 and 3). Taking this phenomenon as a premise, an example of the present invention is explained with reference to FIG. 4, for example. Reference numeral 23A in FIG. 4 denotes a first air opening for supplying air cleaned by the air cleaner 23 (FIG. 3) to the air passage 3. Numeral 23M denotes a second air opening for supplying air purified in the air cleaner 23 to the air-fuel mixture passage 2.

Still referring to FIG. 4, the air cleaner 23 has a guide member 30. A flow 20 of fuel-free air, which flows back to the air cleaner 23 through the first air opening 23A due to the air blow-back, is guided to near the second air opening 23M by the guide member 30, and encounters a flow 21 of air-fuel mixture blow-back that rushes through the second air opening 23M into the air cleaner 23. In the example of FIG. 4, the guide member 30 is opposed to the second air opening 23M, and has a rebounding surface 30*a* that bounces the pressure of the air-fuel mixture blow-back flow 21 from the second air opening 23M and redirects it back toward the second air opening 23M. Therefore, by guiding the fuel-free air flow 20 to the region near the air opening 23M, the air-fuel mixture flow 21 running back through the second air opening 23M into the air cleaner 23 can be detained within an area near the second air opening 23M.

As such, by temporarily retaining the back flow of air-fuel mixture into the air cleaner 23 through the second air opening 23M within a limited area near the second air opening 23M, the dwelling air-fuel mixture near the second air opening 23M is more easily drawn into the air-fuel mixture passage 2 when the air-fuel mixture passage 2 is reduced in pressure by the upward movement of the piston P.

In FIG. 4, the first air opening 23A is located above the second air opening 23M, and an air induction opening 31 for introducing air purified by the air cleaner 23 into the guide member 30 opens upward. Air introduced through the air induction opening 31 into the guide member 30 is distributed to the first and second air openings 23A, 23M.

In the configuration of FIG. 4, the guide member 30 is shown as a member formed independently from the air cleaner 23 and removably attachable to the air cleaner base. However, as shown in FIG. 5, the guide member 30 may be formed as an integral part of the air cleaner 23. Also in examples shown in FIG. 6 et seq., the guide member 30 may be either an inseparable member fixed to the air cleaner 23, an integral part of the air cleaner 23, or a separate member removably attachable to the air cleaner 23.

With reference to FIG. 6, the guide member 30 shown here comprises an air guide plane 30*b* that faces to the first air opening 23A to guide a fuel-free air flow 20 from the first air opening 23A back to near the second air opening 23M and an air-fuel mixture guide plane 30*c* that faces to second air opening 23M to guide an air-fuel mixture flow 21 to near the second air opening 23M. These air guide plane 30*b* and air-fuel mixture guide plane 30*c* of the guide member 30 shown in FIG. 6 form a continuous, arcuate cross-sectional inner surface of the guide member 30.

As such, by providing the air guide plane 30*b* in confrontation with the first air opening 23A and the air-fuel mixture guide plane 30*c* in confrontation with the second air opening 23M, it is possible to direct the air-fuel mixture flow 21 from the second air opening 23M toward the first air opening 23A. Soon after, against this air-fuel mixture flow 21, the fuel-free air flow 20 flowing out from the first air opening 23A collides. As a result, the air-fuel mixture flow 21 flowing out from the second air opening 23M can be retained near around the second air opening 23M.

The example of FIG. 6 also shows the use of a passage extension member having an L-shaped cross section in association with the second air opening 23M communicating with the air-fuel mixture passage 2. The L-shaped passage extension member 32 encircles the second air opening 23M from apart it. Part of the air-fuel mixture flow 21 flowing out from the second air opening 23M hits a bouncing plane 32*a* opposed to the second air opening 32M of the L-shaped passage extension member 32, and fuel components and lubricant components in the air-fuel mixture adhere to the bouncing plane 32*a*. This contributes to suppressing that fuel and lubricant components flow out pass the L-shaped passage extension member 32 into the inner space of the air cleaner 23. Air cleaned by the air cleaner element 24 (FIG. 3) enters into the inside of the L-shaped passage extension member 32 through an air induction opening 33 at the distal end of the L-shaped passage extension member 32, and it is distributed to the first and second air openings 23A, 23M.

Different air cleaners 23 having L-shaped passage extension members 32 different in length may be prepared as optional members such that any user can select an air cleaner 23 having the best length of the L-shaped extension member 32 for tuning the engine to his/her desired properties.

More specifically, the L-shaped passage extension member 32 substantially extends the length of the air-fuel mixture passage 2. Therefore, if some different types of air cleaner 23 different in length of the passage defined by the L-shaped passage extension member 32 are prepared, one of the different types of air cleaner 23 having the L-shaped passage extension member 32 optimum in passage length for realization of user's desired engine properties can be mounted on the engine 1. Thus, the engine can be readily tuned. Further, the L-shaped passage extension member 32 separates fuel and lubricant components contained in the blow-back flow of the air-fuel mixture, and thereby prevents such fuel and lubricant components from flowing into the inner space of the air cleaner 23 pass the L-shaped passage extension member 32.

In designs where the L-shaped passage extension member 32 is an integral part of the air cleaner 23, different types of air cleaners 23 that are different in length of the L-shaped passage extension member 32 may be prepared. In contrast, in designs where the L-shaped passage extension member 32 is an separate member attachable to the air cleaner 23, different kinds of L-shaped passage extension member 32 different in length of passage may be prepared, and one of such L-shaped passage extension members 32 having a length suitable for realizing user's desired engine properties may be assembled to the air cleaner 23. The portion depicted by an imaginary line and labeled with the numeral 32 in FIG. 6 is an extended part of a longer L-shaped passage extension member 32 whereas the portion depicted by a solid line and labeled with the numeral 32 is a shorter L-shaped passage extension member 32.

Heretofore, the blow-back flow 20 of air that occurs in the air passage 3 has been explained from the viewpoint of an air flow. However, the blow-back of air occurring in the air passage 3 can be explained from the viewpoint of pressure as well. FIG. 7 is a diagram for explaining the present invention from the view point of pressure.

With reference to FIG. 7, the guide member 30 includes a first diagonal guide wall member 34 provided at the first air opening 23A. The first diagonal guide wall member 34 slants in a direction getting closer to the second air opening 23M with a slanting angle preferably about 45 degrees. The guide member 30 further includes a second guide member 35 located to face the second air opening 23M. The second a guide member 35 has a diagonal bouncing plane 35*a* that bounces the blow-back pressure of the air-fuel mixture from the second air passage 2 and redirects it toward the first air opening 23A. The diagonal bouncing plane 35*a* preferably inclines by approximately 45 degrees relative to the opening plane of the second air opening 23M.

The fuel-free air flow 20 flowing out of the first air opening 23A into the air cleaner 23 is directed toward the diagonal wall surface 35*a* by the first diagonal guide wall member 34. On the other hand, the blow-back pressure of the air-fuel mixture flowing out of the second air opening 23M is rebounded by the diagonal wall plane 35*a* toward the first air opening 23A, and hits the fuel-free air flow 20. As a result, the air-fuel mixture blow-back flow 21 is retained near the second air opening 23M.

FIG. 7 illustrates the second guide member 35 in front of the second air opening 23M as being a apart of the L-shaped passage extension member 32, the second guide member 35 is not limitative to this configuration.

FIGS. 8 and 9 show modifications of the second guide member 35. As shown in FIG. 8, the second guide member 35 may include a bouncing plane 35*b* located in front of the second air opening 23M in communication with the air-fuel mixture passage 2, and opposed to the second air opening 23M. Alternatively, as shown in FIG. 9, the second guide member 35 may comprise a guide plane 35*c* that directs the air-fuel mixture flow 21 from the second air opening 23M toward the area of the first air opening 23A.

FIG. 10 shows a configuration in which the guide member 30 comprises an umbrella member 36 located in front of, but apart from, the first and second air openings 23A, 23M of the air cleaner 23. The umbrella member 36 may be placed inside the air cleaner 23, for example, by fixing it to a partition plate 36 that partitions the interior space of the air cleaner 23 into two chambers. In FIG. 10, reference numeral 37*a* denotes through bores formed in the partition plate 37 to permit air cleaned by the air cleaner element 24 (FIG. 3) to pass through. Flows of air cleaned by the air cleaner element 24 are shown by arrows in FIG. 10.

In the example of FIG. 10, the umbrella member 36 has an arch-shaped bounding plane 36*a*. Alternatively, as shown in FIG. 11, the umbrella member 36 may comprise a first and a second two diagonal bounding planes 36*b*, 36*c*. As shown in FIG. 12, the umbrella member 36 may be provided as a part of the L-shaped passage extension member 32. Although FIG. 12 illustrates the umbrella member 36 as having an arch-shaped guide plane 36*a*, it will be apparent that it may be replaced by the umbrella member 36 having the first and second diagonal planes 36*b*, 36*c* shown in FIG. 11.

FIGS. 13 and 14 show examples in which the air cleaner 23 includes an interconnection member 38 that makes communication between the first and second air openings 23A, 23M within a closed space and the interconnection member 38 acts as the above-mentioned guide member 30. The interconnection member 38 shown in FIG. 13 defines the arch-shaped guide plane 38*a* whereas the interconnection member 38 shown in FIG. 14 defines the first and second diagonal planes 38*b*, 38*a*. The interconnection member 38 has air induction openings 39 in its side wall. Air cleaned by the air cleaner 23 enters into the space closed by the interconnection member 38 through the air induction openings 39, and it is distributed to the first and second air openings 23A, 23M. The air induction openings 39 are preferably located nearer to the first air opening 23A, i.e. nearer to the air passage 3. In other words, the air induction openings 39 are preferably located remoter from the second air opening 23M in communication with the air-fuel mixture passage 2 to prevent leakage of the air-fuel mixture into the inner space of the air cleaner 23 through the air induction openings 39.

Also in the examples of FIGS. 13 and 14, a part of the inner plane of the interconnection member 38, which is opposed to the second air opening 23M, may be a bouncing plane that bounds the pressure of the air-fuel mixture flow 21 from the second air opening 23M back toward the second air opening 23M. Alternatively, a part of the inner surface of the interconnection member 38, which is opposed to the first air opening 23A, may be formed as a diagonal plane that forcibly directs the pressure of the fuel-free air 20 from the first air opening 23A toward the second air opening 23M.

FIGS. 15 and 16 illustrate a modification of the interconnection member 38. FIG. 16 shows its cross-sectional configuration taken along the X16-X16 line of FIG. 15. The interconnection member 38 includes an inner circular wall 40 separating an inner space in communication with the second air opening 23M from an outer ring-shaped space in communication with the first air opening 23A. The interconnection member 38 further includes an outer circular wall 41 and a flat end ceiling 42 that covers the inner and outer double circular walls 40, 41. The outer circular wall 41 has formed an air induction opening 43 near the first air opening 23A such that the air cleaned by the air cleaner element 24 (FIG. 3) enters into the interconnection member 38 through the air induction opening 43. The inner circular wall 40 further has a communication opening 44 formed to open toward the opposite direction from the air induction opening 43. The communication opening 44 makes communication between the inner space inside the inner circular wall 40 and the space defined between the inner circular wall 40 and the outer circular wall 41.

The air-fuel mixture blow-back flow 21 entering into the air cleaner 23 through the second air opening 23M is turned back by the ceiling wall 42 and returns to the second air opening 23M. At the same time, part of the air-fuel mixture blow-back flow 21 flows into the outer ring-shaped space through the communication opening 44 of the inner circular wall 40. On the other hand, the fuel-free air blow-back flow 20 flowing into the air cleaner 23 through the first air opening 23A is guided and directed toward the communication opening 44 by circular wall surfaces of the inner and outer circular walls 40, 41 defining the outer ring-shaped space, and hits the air-fuel mixture in the outer ring-shaped space. Thus, the air-fuel mixture can be retained in the outer ring-shaped space.

In the examples explained heretofore, configurations encircling the second air opening 23M related to the air-fuel mixture and locating the air induction opening 33 at an upper position apart from the second air opening 23M as shown in FIGS. 6, 7 and others are effective for retaining air-fuel mixture having a relatively heavy specific gravity in the vicinity of the second air opening 23M.

In configurations where the area around the second air opening 23M is open as shown in FIGS. 10, 11 and 12, it is recommended to locate the second air opening 23M below the first air opening 23A. Upwardly directing the air-fuel mixture flow 21 from the second air opening 23M located under the first air opening 23A is effective to retain the air-fuel mixture having a relatively heavy specific gravity near around the second air opening 23M.

The foregoing examples have been explained above as having a single first air opening 23A and a single second air opening 23M. Instead, however, the air cleaner may also have a plurality of first air openings 23A in communication with the air passage 3. In this case as well, it is possible to retain the air-fuel mixture flowing out from the second air opening 23M near around the second air opening 23M by guiding fuel-free air flows flowing back from the first air openings 23A too near the second air opening 23M with a guide member shown by reference numeral 50 in FIG. 17. Therefore, the present invention is applicable to engines having a plurality of first air openings 23A or a plurality of air passages 3 by using various types of guide members not limited to the guide member 50 shown in FIG. 17.

In the present invention summarized heretofore, it will be apparent that the air-fuel mixture passage and the air passage 3 may be adjusted in ratio of their lengths to make an optimum ratio of their lengths to maximize the intended effect of the present invention in a normal revolution range of an engine 1.

BEST MODES FOR CARRYING OUT THE INVENTION

Preferred embodiments are explained below with reference to accompanying drawings.

First Embodiment

FIGS. 18 Through 24

With reference to FIG. 18, a two-stroke internal combustion engine 100 is a gasoline engine fired by gasoline and an air-cooled engine having a single cylinder. This two-stroke gasoline engine 100 is a four-flow scavenging engine used in portable power working machines.

The engine 100 comprises a cylinder block 102 and a crankcase 103 connected under the cylinder block 102. A cylinder 104 formed in the cylinder block 102 fittingly, reciprocally accommodates a piston 105 that defines a combustion chamber 106 in the cylinder 104.

The combustion chamber 106 is of a squish dome design (hemispherical). At the top of the combustion chamber 106, an ignition plug 107 is located. The engine 100 further comprises a sealed crank chamber 108 defined by the crankcase 103.

The crank chamber 108 rotatably accommodates a crankshaft 109 supported on a pivot in the crankcase 103. The crankshaft 109 and the piston 105 are connected by a connection rod 110. Reciprocating motion of the piston 105 is translated to rotation, and the rotation is output as a power of the engine 100.

The cylinder block 102 defines a single exhaust port 111 that opens into the cylinder 104 to discharge the combustion gas externally and a pair of first and second scavenging windows 112, 113 of a Schnurle scavenging type, which are formed at right and left symmetrical position about an imaginary line connecting the center of the exhaust port 111 and the center of a horizontal cross section of the cylinder 104.

Top edges of the first and second scavenging windows 112, 113 are located lower than the top edge of the exhaust port 111. The top edge of the first scavenging window 112 closer to the exhaust port 111 and the top edge of the second scavenging window 113 remoter from the exhaust port 111 may be either at an equal height level or at different height levels. In a design where the top edge of the second scavenging window 113 is at a higher level than the top edge of the first scavenging window 112, it is recommended to supply the second scavenging window 113 with fuel-free air.

In a design where the top edges of the first and second scavenging windows 112, 113 are at an equal height level, the piston 105, in its down stroke, first opens the exhaust port 111 and, immediately after, opens the first and second scavenging windows 112, 113 simultaneously.

In a design where the height of the top edge of the second scavenging window 113 is higher than the top edge of the first scavenging window 112, the piston 105, in its down stroke, first opens the exhaust port 111, soon after opens the second scavenging window 113 and next opens the first scavenging window 112.

The first and second scavenging windows 112, 113 are directed opposite from the exhaust port 111 in their horizontal attitudes, and directed upward in their vertical attitudes. The first and second scavenging windows 112, 113 communicate with the crank chamber 108 respectively through first and second scavenging channels 115, 116.

The cylinder block 102 further defines an air-fuel mixture port 118 at a position diametrically opposite from the exhaust port 111. The air-fuel mixture port 118 is opened by the sidewall of the piston 105 like the exhaust port 111, first scavenging window 112 and second scavenging window 113. That is, the engine 100 is one of cylinder-port type engines. Instead, however, the air-fuel mixture port 118 may be opened by a reed valve (labeled with numeral 200 in FIG. 54 explained later).

The intake system 120 of the engine 100 includes an air passage 124 and an air-fuel mixture passage 125 defined by an adapter 121 and a carburetor 122. The carburetor 122 has an air cleaner 127 removably mounted thereon. The air passage 124 is in communication with the second scavenging channel 116 via first and second air distribution channels 128 (only one of them appears in the drawings). A reed valve (not shown) is provided at the connection between the first and second distribution channels 128 and the second scavenging channel 116. At the location of the carburetor 112 in the air passage 124, a rotary valve 130 is illustrated. On the other hand, at the location of the carburetor 112 of the air-fuel mixture passage 125, a throttle valve (not shown) is provided as an engine power control valve.

In the above-explained engine 100, the air distribution channel 128 is connected to the second scavenging channel 116 that communicates the second scavenging window 113 remoter from the exhaust port 111 with the crank chamber 108 such that the fuel-free air not containing air-fuel mixture is supplied to the second scavenging channel 116. Instead, however, the air distribution channel 128 may be connected to the first scavenging channel 115 in association with the first scavenging window 112 closer to the exhaust port 111.

In case the fuel-free air in the air passage 124 is supplied to the first scavenging channel 115 by connecting the air distribution channel 128 to the first scavenging channel 115, the top edges of the first and second scavenging channels 115, 116 may be at the same height, or the top edge of the first scavenging channel 115 may be at the higher level than the top edge of the second scavenging channel 116. It has been experimentally confirmed that the stratified scavenging effects can be improved by supplying the first scavenging channel 115 in communication with the first scavenging window 112 with fuel-free air in this manner. Therefore, the air cleaner according to the present invention is preferably applied to engines of a type in which fuel-free air is supplied to the first scavenging channel 115 in communication with the first scavenging window 112.

The air cleaner 127 includes an air cleaner base 135 removably fixed to the carburetor 122, which is an element of the engine intake system, by bolts, for example, and an outer case 137 cooperating with the air cleaner base 135 to define an air cleaner chamber 136. The outer case 137 is removably attached to the air cleaner base 135, and the outer case 137 can be removed to replace or clean the air cleaner element 138.

The air cleaner element 138 is fixed by bolts or the like, not shown, to the partition plate 139 tightly held between the air cleaner base 135 and the outer case 137. Air enters into one half of the air cleaner chamber 136 defined by the outer case 137 through an air intake opening 137*a* formed in the outer case 137 and cleaned by the air cleaner element 138. The cleaned air then enters into the other half of the air cleaner chamber 136 defined by the air cleaner base 135 through a central opening 139*a* of the partition plate 139.

The air cleaner base 135 has a first and a second air openings 140, 141 formed to be adjacent to each other. FIG. 19 is a plan view of the air cleaner base 135. As best shown in FIG. 19, the first air opening 140 has an elliptic shape longer in the direction normal to an imaginary center line connecting the center of the first air opening 140 and the center of the second air opening 141 in its plan view. The first air opening 140 communicates with the air passage 124 (FIG. 18). The second air opening 141 is circular in its plan view, and it communicates with the air-fuel mixture passage 125 (FIG. 18).

With reference to FIG. 19, the first air opening 140 and the second air opening 141 are surrounded by a border uprising wall 142 that extends continuously. As best shown in FIG. 20, height of the border uprising wall 142 is designed to be relatively low around the first air opening 140, i.e. at the portion associated with the air passage 124 and relatively high around the second air opening 142, i.e. at the portion associated with the air-fuel mixture passage 125.

A guide member 144 is fixed on the top surface of the border uprising wall 142 around the second air opening 141. The guide member 144 may be attached to the border uprising wall 142 by removable engagement. As best shown in FIGS. 23 and 24, the guide member 144 has an elongated upside-down cup-shaped configuration. The first air opening 140 and the second air opening 141 are commonly covered by the guide member 144 in a condition communicating with each other. In other words, the guide member 144 permits the first and second air openings 140, 141 to communicate with each other in a closed space. It corresponds to the interconnection member 38 shown in FIGS. 13 and 14. Since the height of the border uprising wall 142 is low near the first air opening 140, the closed space defined by the guide member 144 and the air cleaner chamber 136 communicate through an air induction opening 145 (FIG. 18) extending along the periphery of the first air opening 140. The air cleaned by the air cleaner element 138 enters into the guide member 144 through the air induction opening 145, and it is distributed to the first air opening 140 and the second air opening 141.

A ceiling wall surface 144*a* of the guide member 144 has arch-shaped end portions in the direction extending along the imaginary center line connecting the center of the first air opening 140 and the center of the second air opening 141. The central part of the ceiling wall surface 144*a* is flat. It is also acceptable that the inner wall surface 144*a* of the guide member 144 is entirely shaped arcuate along the imaginary centerline connecting the centers of the first air opening 140 and the second air opening 141.

In the expansion stroke, air-fuel mixture flowing out of the second air opening 141 due to the blow-back of air-fuel mixture is bounced back to the second air opening 141 by the ceiling wall surface 144*a* of the guide member 144. Immediately thereafter, fuel-free air flowing out of the first air opening 140 due to the blow-back of air is guided to near the second air opening 141 by the guide member 144, and acts to retain the air-fuel mixture near the second air opening 141.

Second Embodiment

FIGS. 25 Through 32

The second embodiment is different from the first embodiment explained above only in the air cleaner 127, and common too the first embodiment in the other respects. Therefore, the following explanation is centered to differences from the first embodiment while omitting the common features by labeling them with common reference numerals.

The first air opening 140 in communication with the air passage 124 of the intake system 120 and the second air opening 141 in communication with the air-fuel mixture passage 125 are surrounded by the border uprising wall 142 like the first embodiment.

Unlike the first embodiment, the border uprising wall 142 has a uniform height over the entire circumference. As best shown in FIGS. 25 and 30, the guide member 150 used in the second embodiment has an elongated upside-down cup-shaped configuration. The first air opening 140 and the second air opening 141 are covered by the guide member 150 in a condition communicating with each other. That is, the guide member 150 permits the first and second air openings 140, 141 to communicate in a closed space. It corresponds to the interconnection member 38 already explained with reference to FIG. 13 and others.

With reference to FIG. 31, the guide member 140 used in the second embodiment has an rectangular shape in a portion thereof associated with the first air opening 140 in communication with the air passage 124 in its plan view. At the opposite sides thereof, air induction tubes 151 are formed respectively. In other words, one pair of air inlet tubes 151 are provided in alignment with the first air opening 140 of the guide member 150 to extend in a direction normal to the imaginary center line connecting the centers of the first air opening 140 and the second air opening 141. In each air induction tube 151, an air induction channel 151*a* having a circular cross-sectional configuration is formed (FIG. 30). Axial lines of the pair of air induction channel 151*a* lie on the longer axis of the first air opening 140 having an elliptic shape in its plan view. As a matter of course, one or the other of the air induction tubes 151 may be omitted.

As explained above, the border uprising wall 142 surrounding the first and second air openings 140, 141 and extending all around the circumference has a uniform height over the entire circumference thereof. The guide member 150 in the second embodiment is put on and bonded to the top surface of the border uprising wall 142. Alternatively, the guide member 150 may be removably attached to the border uprising wall 142 by removable engagement with the outer circumferential surface of the border uprising wall 142. Thus, the first and second air openings 140, 141 are covered by the guide member 150 in a condition communicating with each other, and the inner space defined by the guide member 150 communicates with the air cleaner chamber 136 only through the air induction tube 151 near the first air opening 140. Air cleaned by the air cleaner element 138 (FIG. 25) enters into the inner space defined by the guide member 150 through the air induction channels 151*a* extending in and through the air induction tubes 151, and it is distributed to the first air opening 140 and the second air opening 141.

In the second embodiment as well, like the first embodiment, air-fuel mixture flowing out of the second air opening 141 due to the blow-back of air-fuel mixture bounced back to the second air opening 141 by the ceiling wall 150*a* (FIG. 30) of the guide member 150. Immediately thereafter, fuel-free air flowing out of the first air opening 140 due to the blow-back of air is guided to the region near the second air opening 141 and makes the air-fuel mixture to stay near the second air opening 141.

In the second embodiment, some types of guide member 150 different in length and shape of the air induction tubes 151 may be prepared such that an optimum one of the different types of guide member 150 for realizing engine properties satisfying user's particular requests may be selected and attached to the air cleaner 127. Alternatively, some types of air cleaner base 135 having different types of guide member 150 unremovably fixed to the border uprising wall 142 by bonding, etc. may be prepared such that an optimum type of air cleaner base for realizing engine properties a particular user requests may be assembled in the engine 100. Thereby, engine properties can be readily tuned.

Third Embodiment

FIGS. 33 Through 40

The third embodiment is a modification of the second embodiment explained above. Its essential difference from the second embodiment lies in the shape of the guide member now labeled with 160. As best shown in FIG. 38, the guide member 160 used in the third embodiment has air induction tubes 161 corresponding to the air induction tubes 151 of the second embodiment. The air induction tubes 161 are oriented diagonal relative to the longer axis of the first air opening 140 having an elliptic configuration in its plan view, and extending directions of the air introduction tubes 161 orient toward the first air opening 140. Reference numeral 162 denotes an air induction channel defined by each air induction tube 161.

By diagonally orienting the air induction tubes 161, in the process where air is cleaned by the air cleaner element 138, then enters from the air induction tubes 161 into the space defined by the guide member 160 and is distributed to the first air opening 140 and the second air opening 141, the flow of air toward the second air opening 141 can be smoothed because the air induction channels 162 are directed toward the second air opening 141.

Fourth Embodiment

FIGS. 41 Through 47

The fourth embodiment is a modification of the second and third embodiments as well. Its essential differences from the second and third embodiments lie in the configuration of the guide member 170 now labeled with numeral 170 and in uprising walls 171 through 173 (FIG. 42) acting as pedestals of the guide member 170.

As best shown in FIG. 42, the air cleaner base 135 has a first uprising wall 171 formed to surround the second air opening 141 in communication with the air-fuel mixture passage 125 excepting its part adjacent to the first air opening 140, a second uprising wall 172 formed in one side of the first air opening 140 in communication with the air passage 124, which is remoter from the second air opening 141, and a pair of third uprising walls 173 spaced apart in the longer axis direction of the first air opening 140 having an elliptic configuration in its plan view. The first to third uprising walls 171 to 173 have a uniform height.

With reference to FIG. 46, the guide member 170 used in the fourth embodiment has a pair of air inducing portions 174 in an opposed relation in the longer axis direction of the first air opening 140 having the elliptic configuration in its plan view. In each air inducing portion 174 two air induction openings 174*a* are formed to open in confrontation in a direction parallel to an imaginary center line connecting the centers of the first and second air openings 140, 141.

The guide member 170 used in the fourth embodiment enables the air cleaned by the air cleaner element 138 to enter into an air inlet channel 175 through four air induction openings 174*a* in total. Therefore, it is easy to introduce a great deal of air into the air induction channel 175. In addition, since air can be introduced from all regions of the air cleaner chamber 136, cleaning of air using the entirety of the air cleaner element 138 is possible. Reference numerals 176 to 178 denote sidewall portions corresponding to the first to third uprising walls 171-173.

Fifth Embodiment

FIGS. 48 Through 51

The fifth embodiment is an embodiment for explaining that the air cleaner base 135 and the guide member 180 can be formed as an integral body. The dome-shaped guide member 180 making communication between the first air opening 140 and the second air opening 141 is integrally formed in the air cleaner base 135. The dome-shaped guide member 180 has an air induction opening 181 formed in a sidewall adjacent to the first air opening 140 to extend continuously along a half round of the first air opening 140.

Sixth Embodiment

FIGS. 52 and 53

In the sixth embodiment, the guide member explained heretofore comprises a main guide member 190 and a receiving member 191 that are associated with the first air opening 140 in communication with the air passage 124 and the second air opening 141 in communication with the air-fuel mixture passage 125, respectively. The main guide member 190 and the receiving member 191 cooperate not only to retain the air-fuel mixture flowing out of the second air opening 141 due to the blow-back occurring in the expansion stroke within the area near around the second air opening 141 but also to induce the blow-back flow of air flowing out of the first air opening 140 to the vicinity of the second air opening 141.

More specifically, the main guide member 190 includes a sidewall 190*a* formed around the first air opening 140 except a region adjacent to the second air opening 141 and a ceiling wall 190*b* opposed to the first air opening 140. An air flow back from the first air opening 140 can be smoothly directed toward the location of the second air opening 141 by a curved portion 190*d* between the ceiling wall 190*b* and the sidewall 190*a*. That is, the main guide member 190 has an opening 190*c* that opens toward the second air opening 141, and the air flow back from the first air opening 140 is guided toward the location of the second air opening 141 by the opening 190*c* of the main guide member 190. Although the main guide member 190 is formed an integral part of the air cleaner base 135, it may be a separate member as well.

The receiving member 191 is removably attached to the second air opening 141. The receiving member 191 has a triangular configuration covering the entirety of the main guide member 190 when viewed in its plan (FIG. 53). The ceiling wall 191*a* of the receiving member 191 opposed to the second air opening 141 extends in a direction apart from the first second air opening 141 beyond the main guide member 190. The distal end of the receiving member 191 beyond a distal end arcuate portion 191*b* curved downward makes an opening that faces downward. The opening is labeled with numeral 191*c*.

In the expansion stroke, air-fuel mixture flowing out of the second air opening 141 due to the blow-back of air-fuel mixture is bounced by the ceiling wall 191*a* of the receiving member 191 back to the second air opening 141. At the same time, fuel-free air flowing out of the first air opening 140 due to the blow-back of air is guided by the main guide member 190 to the region near the second air opening 141 and acts to retain the air-fuel mixture near around the second air opening 141.

In addition, the receiving member 191 makes a part of the passage for guiding the air cleaned by the air cleaner element 138 to the second air opening 141. That is, the receiving member 191 substantially constitutes a part of the air-fuel mixture passage 125 of the intake system 120. Therefore, engine properties can be tuned by adjusting the length of the receiving member 191.

Taking account of it, different types of receiving member 191 different in length of passage may be prepared such that an optimum one selected from the different types of receiving member 191 may be assembled in the air cleaner 135 to provide an engine having engine properties a particular user requests.

Seventh Embodiment

FIGS. 54 Through 59

The seventh embodiment is an example for explaining that the first to sixth embodiments explained above are applicable to a two-stroke engine 201 having an air-fuel mixture reed valve 200 in the air-fuel mixture port 118.

As shown in FIG. 54, the air-fuel mixture port 118 of the intake system 120 is opened and closed by the air-fuel mixture reed valve 200. The air-fuel mixture reed valve 200 opens and closes depending on the pressure in the crank chamber 108. In greater detail, when the pressure in the crank chamber 108 decreases to a negative value, the air-fuel mixture reed-valve 200 opens, and air-fuel mixture enters from the air-fuel mixture passage 125 into the crank chamber 108. When the pressure in the crank chamber 108 rises to a positive value, the air-fuel mixture reed valve 200 closes. This closing motion of the air-fuel mixture reed valve 200 causes the blow-back of air-fuel mixture in the air-fuel mixture passage 125.

FIG. 55 shows details of the air passage 124. The air passage 124 bifurcates near the engine 201 into right and left branch air passages 202R, 202L, and it is connected to the second scavenging channels 116 via these branch air passages 202R, 202L. These branch air passages 202R, 202L are partly defined by a flexible tube 204 that is an external piping. At extremities of the branch air passages 202R, 202L, air read valves 205 are provided to control the supply of air to the second scavenging channel 116. The air reed valves 205 are not requisite, and may be omitted.

As already explained, the air cleaner 127 borne on the engine 201 comprises the air cleaner base 135 removably attached to the carburetor 122 and the outer case 137 removably attached to the air cleaner base 135. Reference numeral 210 in FIG. 54 denotes an operation knob for fixing the outer case 137 to the air cleaner base 135.

The air cleaner 127 taken as the seventh embodiment is shown as using the guide member 144 explained in the first embodiment. The guide member, however, is not limited to this, and it may replaced with any one of other types of guide member explained with reference to the second to sixth embodiments as explained before. FIG. 56 is a perspective view of the air cleaner 127 to show how the guide member 144 is attached to the air cleaner base 135: Reference numeral 211 denotes a choke lever. The first air port 140 can be adjusted in its opening size by operating the choke lever 211 and swinging a choke plate 212 as shown in FIG. 57. FIG. 58 is a plan view of the air cleaner base 135 from which the guide member 144 has been removed, and FIG. 59 is a cross-sectional view of the air cleaner base 135 taken along a vertical plane.

Eighth Embodiment

FIGS. 60 Through 62

The first to seventh embodiments have been explained as including a single air passage 124 in the intake system 120. The eighth embodiment is an example having two air passages 124. The air cleaner 220 according to the eighth embodiment has two first air openings 140, 140 in the air cleaner base 221. The second air opening 141 is located at a mid position between these two first air openings 140, 140 on a center line connecting the centers of the first air openings 140, 140 (FIGS. 60 and 62). These two first openings 140, 140 and the second air opening 141 located between them are allowed to communicate with each other by a single guide member 225. The guide member 225 is closed in lengthwise middle portions of its opposite sidewalls, i.e. at a portion adjacent to the second air passage, and it is opened in lengthwise end portions of the guide member 225, i.e. at portions adjacent to the first air openings 140, thereby making air induction openings 226.

Ninth Embodiment

FIGS. 63 Through 65

The ninth embodiment is a modification of the foregoing eighth embodiment. The eighth embodiment locates the second air opening 141 in a mid position on the center line between the two air openings 140, 140. The ninth embodiment, however, employs the layout in which two first air openings 140, 140 and a single second air opening 141 are located at three vertices of a triangle when viewed in a plan.

The two first air openings 140, 140 and the single second air opening 141 are allowed to communicate with each other by the bifurcated guide member 230. The guide member 230 permits air flows to enter into the guide member 230 through air induction openings 226, 226 near the two first air openings 140, 140.

Tenth Embodiment

FIG. 66

In the embodiments shown in FIGS. 18 through 62, the air cleaner 127 is directly fixed to the carburetor 122. As shown in FIG. 66 illustrating the tenth embodiment, a second adapter 240 may be interposed between the carburetor 122 and the air cleaner 127, and the air cleaner 127 may be put in a horizontally flat orientation.

KEY TO REFERENCE SYMBOLS AND NUMERALS

Figure 1:
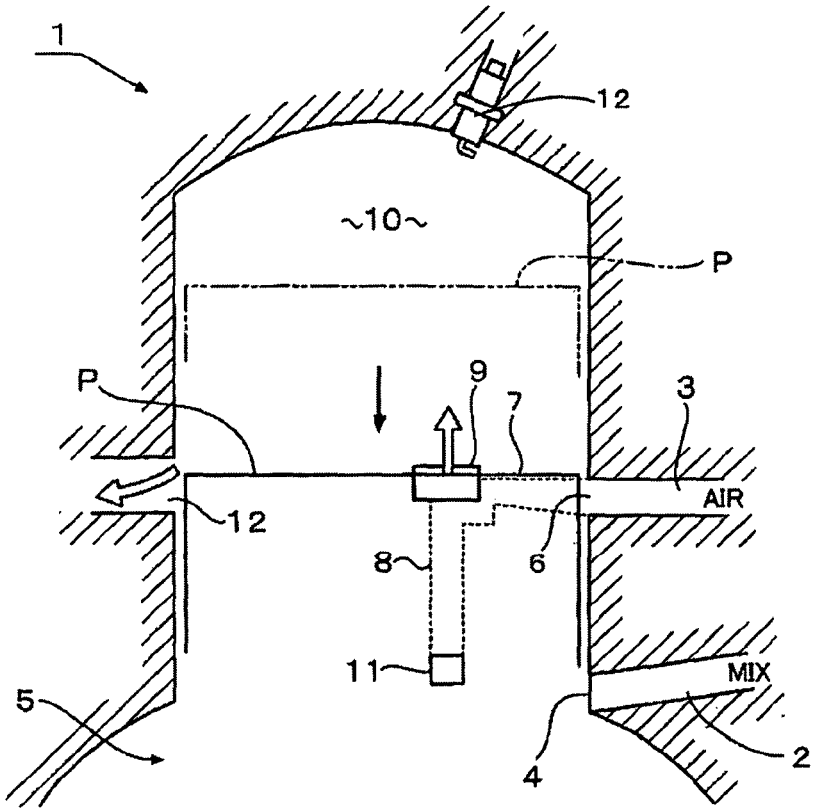
FIG. 1 is a basic structural diagram of a two-stroke internal combustion engine.
Figure 2:
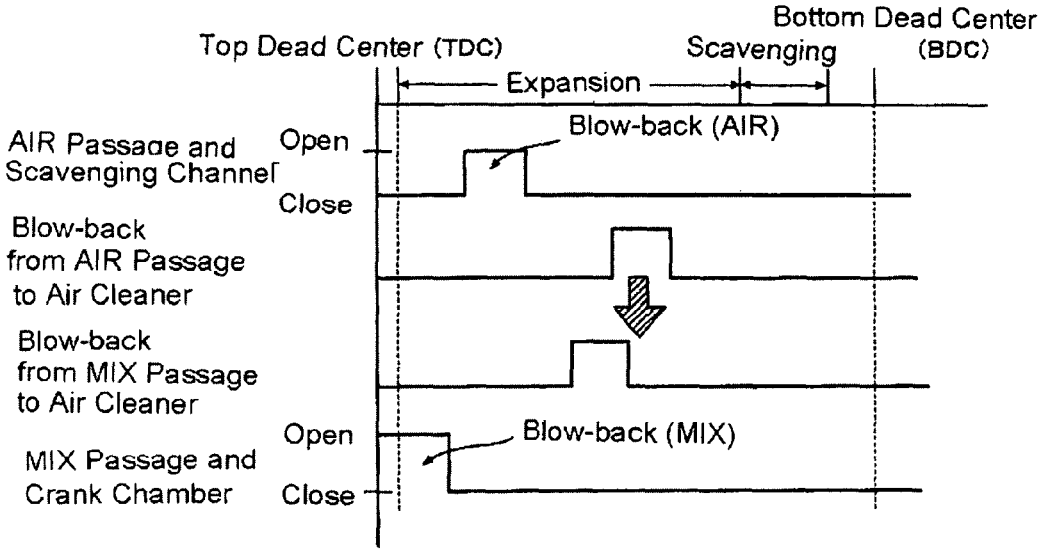
FIG. 2 is a diagram for explaining blow-back of air-fuel mixture and blow-back of air that occur in a stratified-scavenging two-stroke internal combustion engine.
Figure 3:
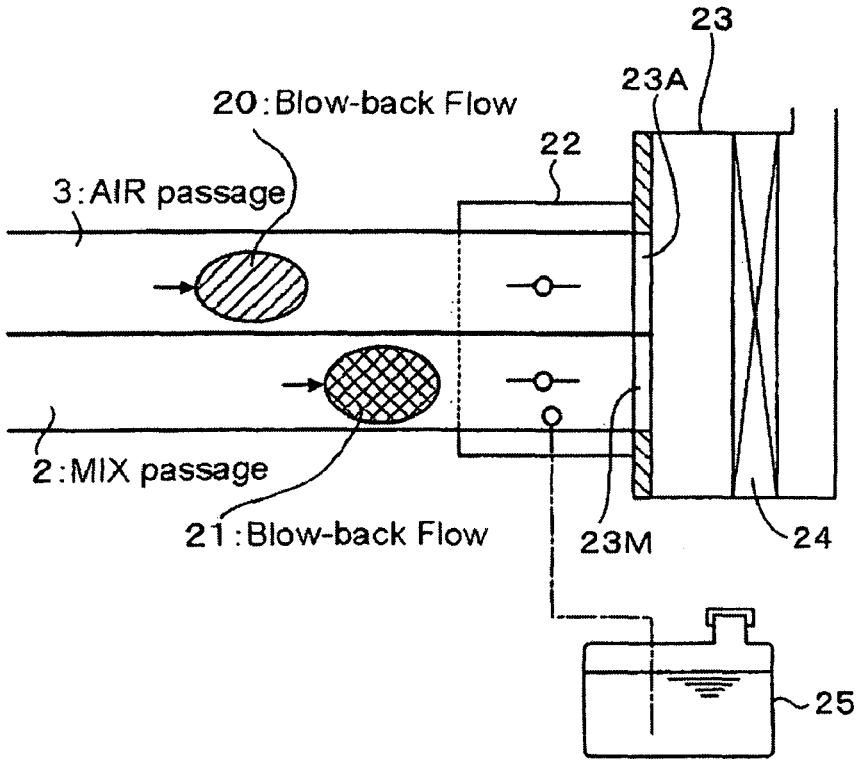
FIG. 3 is a diagram for explaining blow-back of air-fuel mixture and blow-back of air that occur in a stratified-scavenging two-stroke internal combustion engine.
Figure 4:
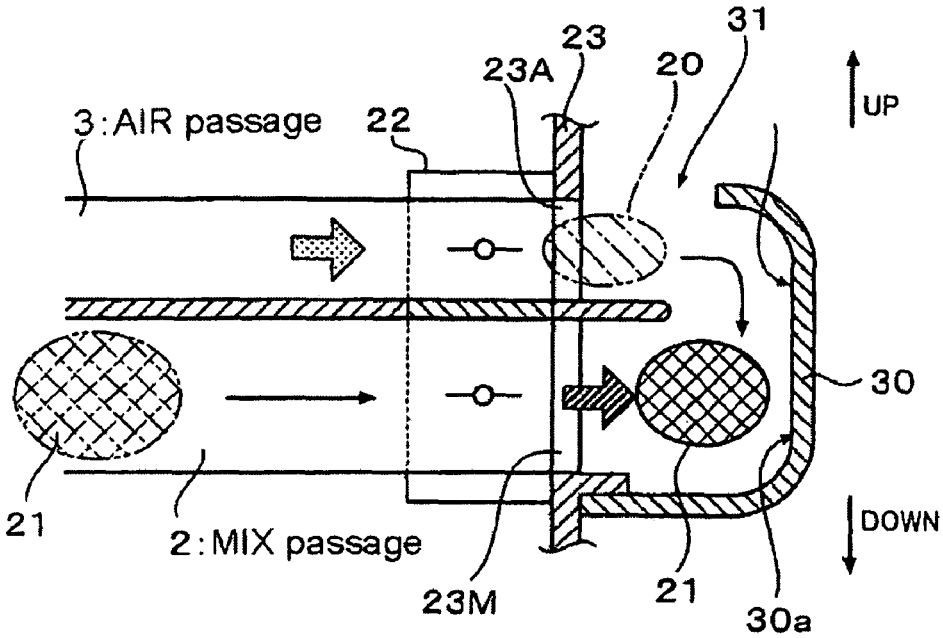
FIG. 4 is a schematic diagram for explaining the basic configuration of the present invention.
Figure 5:
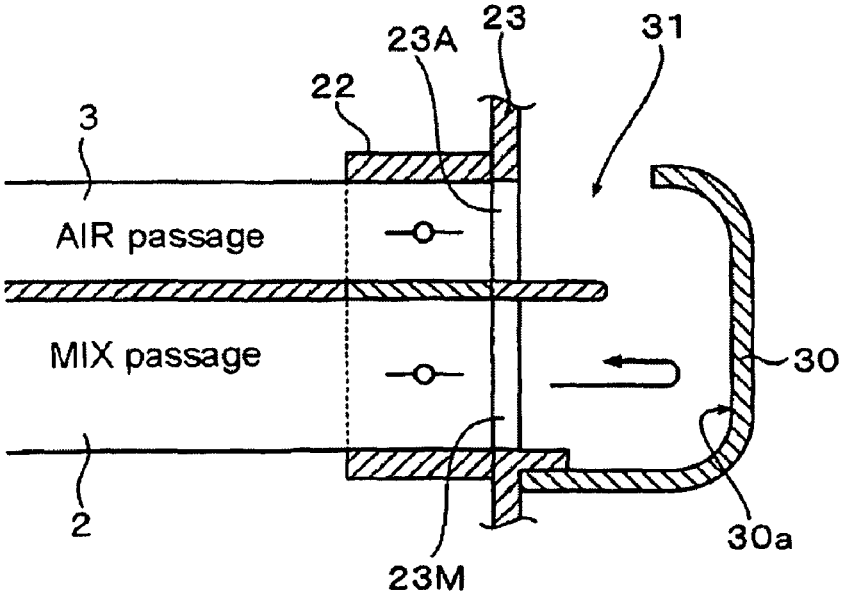
FIG. 5 is a schematic diagram of an example of the present invention.
Figure 6:
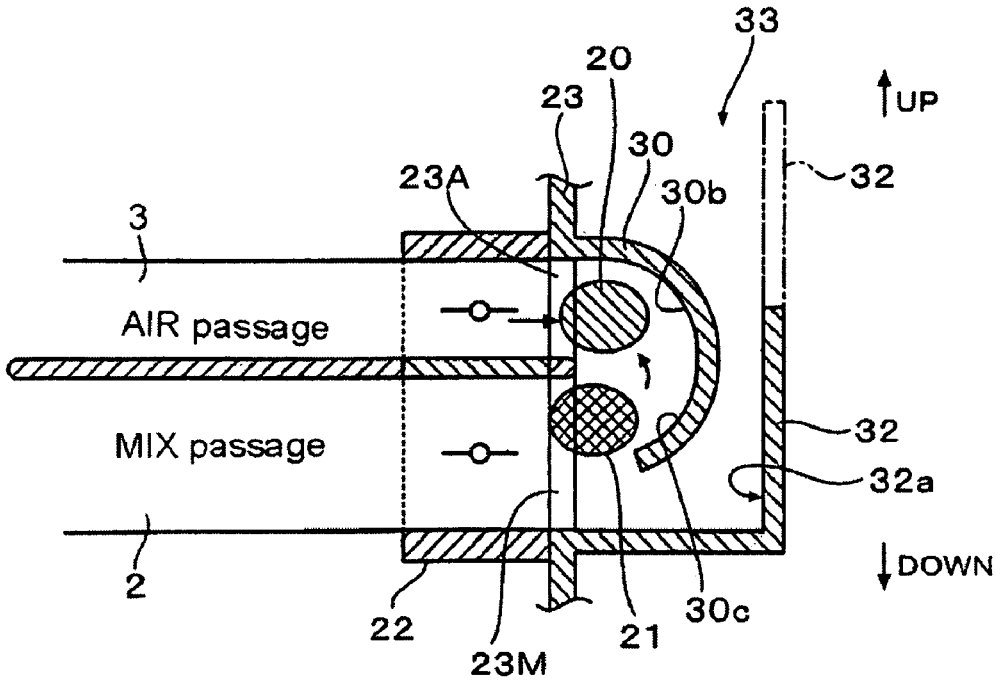
FIG. 6 is a schematic diagram of another example of the present invention.
Figure 7:
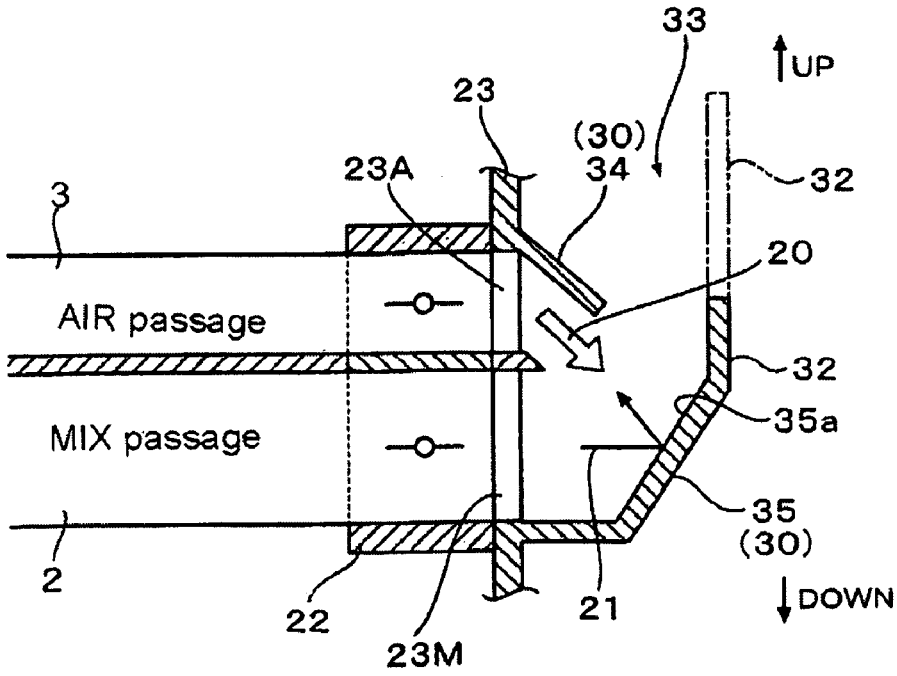
FIG. 7 is a schematic diagram of a further example of the present invention.
Figure 8:
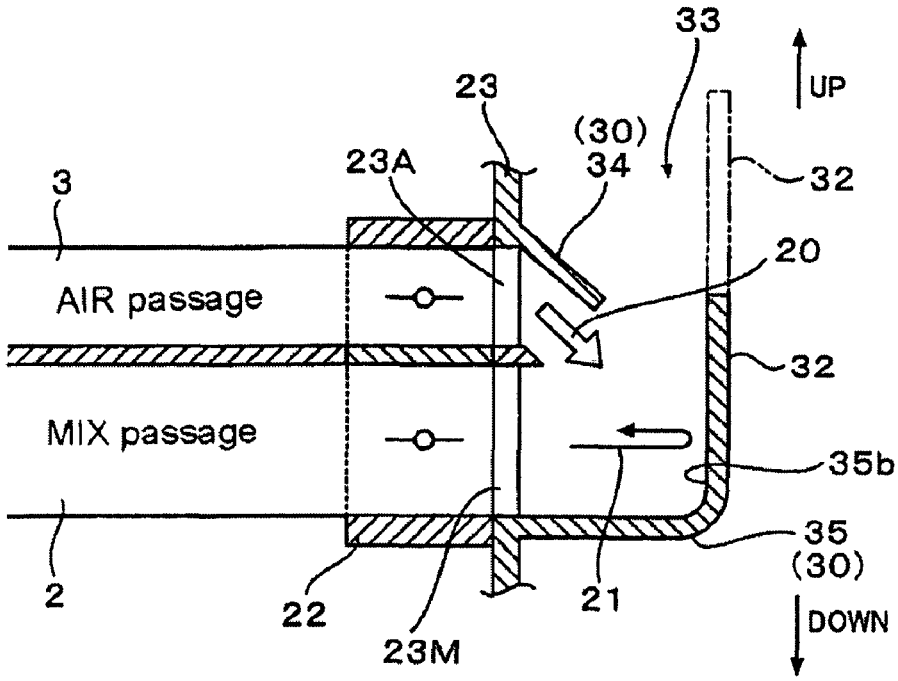
FIG. 8 is a diagram for explaining a modification of FIG. 7.
Figure 9:
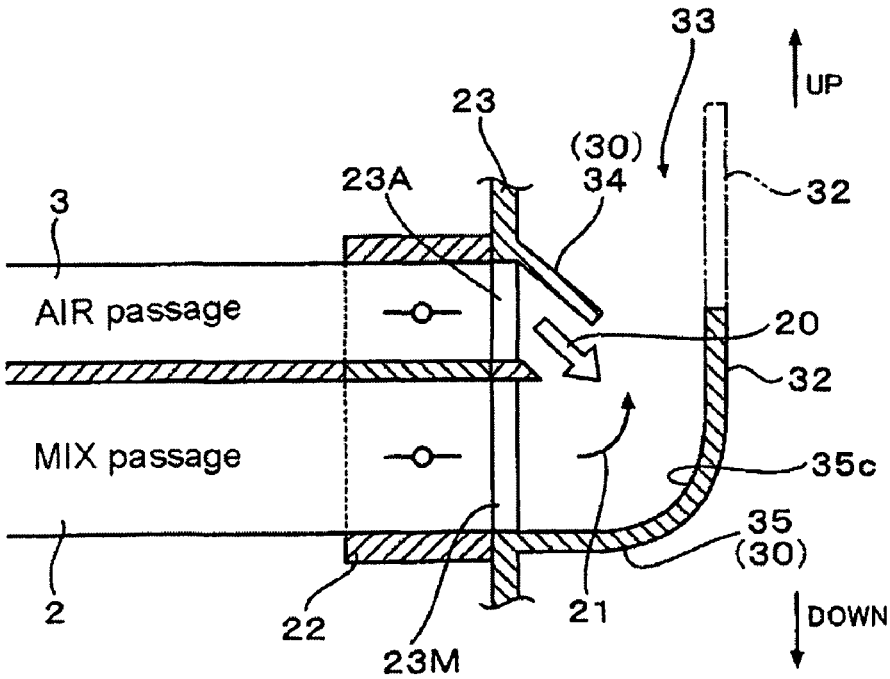
FIG. 9 is a diagram for explaining another modification of FIG. 7.
Figure 10:
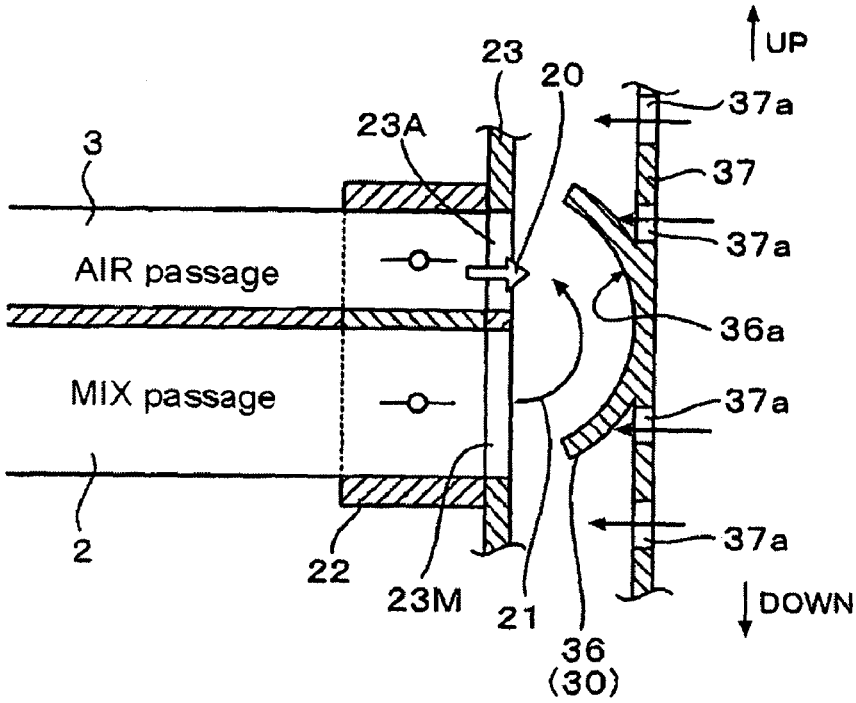
FIG. 10 is a schematic diagram of a still further example of the present invention.
Figure 11:
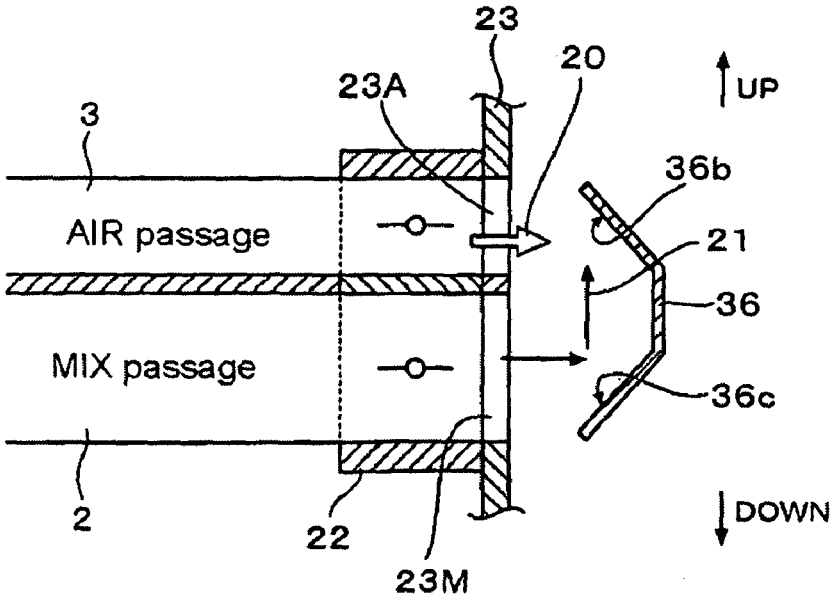
FIG. 11 is a schematic diagram of a modification of FIG. 10.
Figure 12:
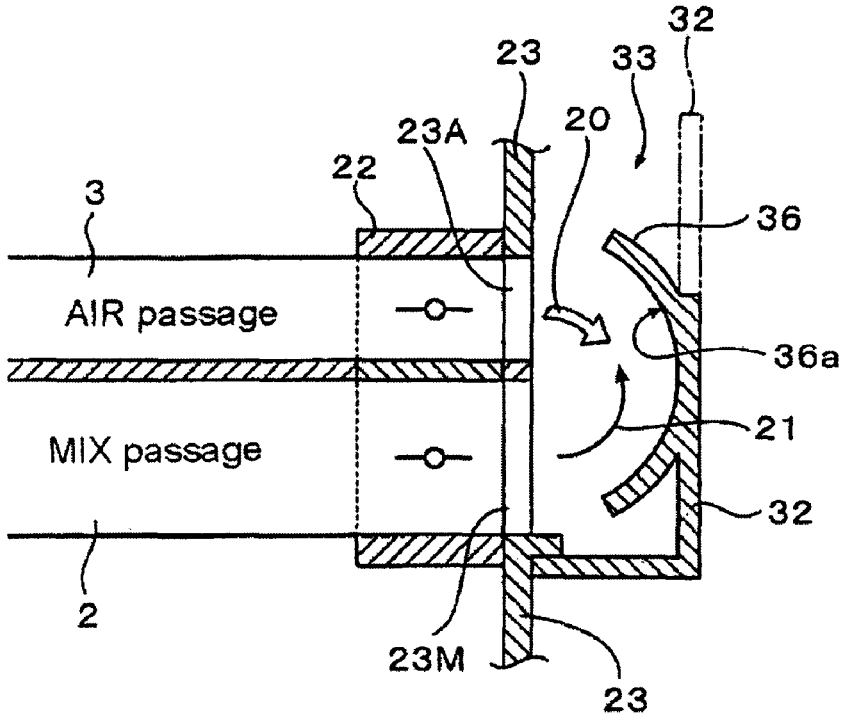
FIG. 12 is a schematic diagram of another modification of FIG. 10.
Figure 13:
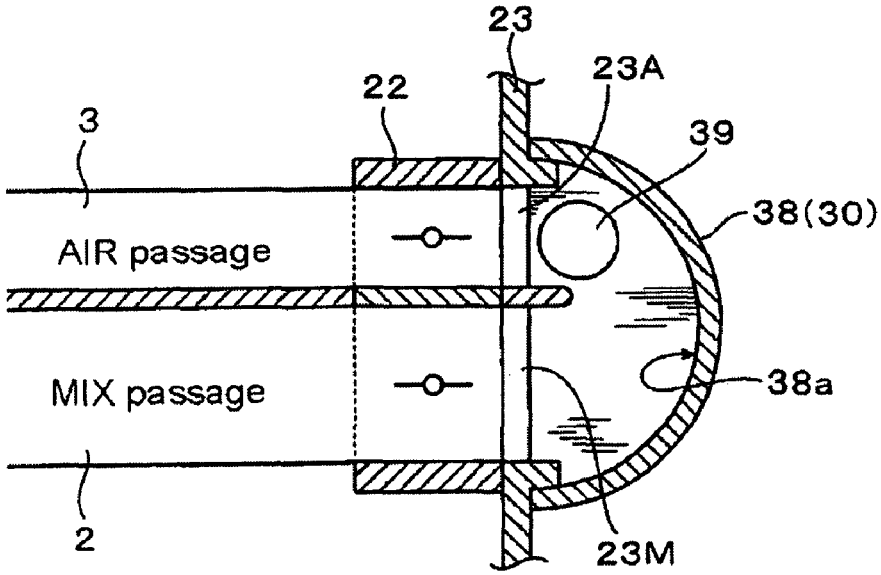
FIG. 13 is a schematic diagram of a yet further example of the present invention.
Figure 14:
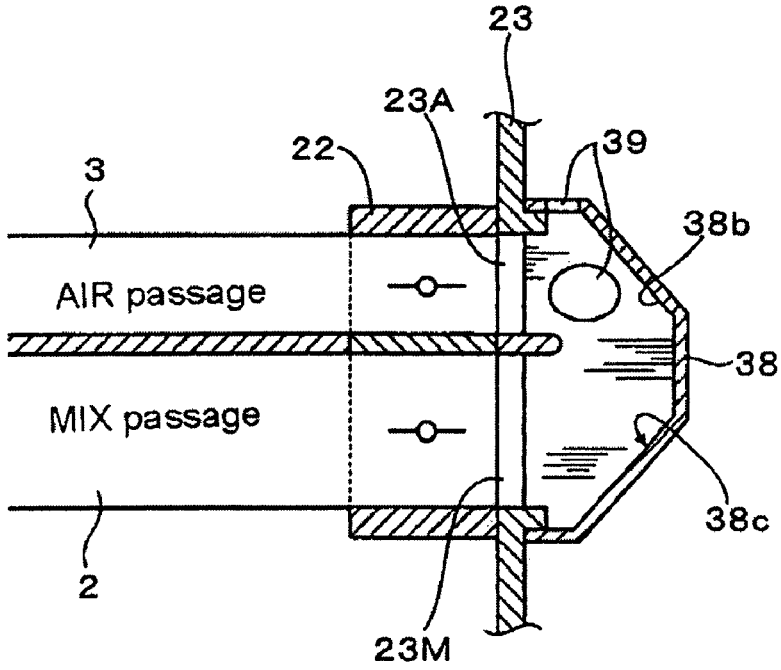
FIG. 14 is a schematic diagram of a modification of FIG. 13.
Figure 15:
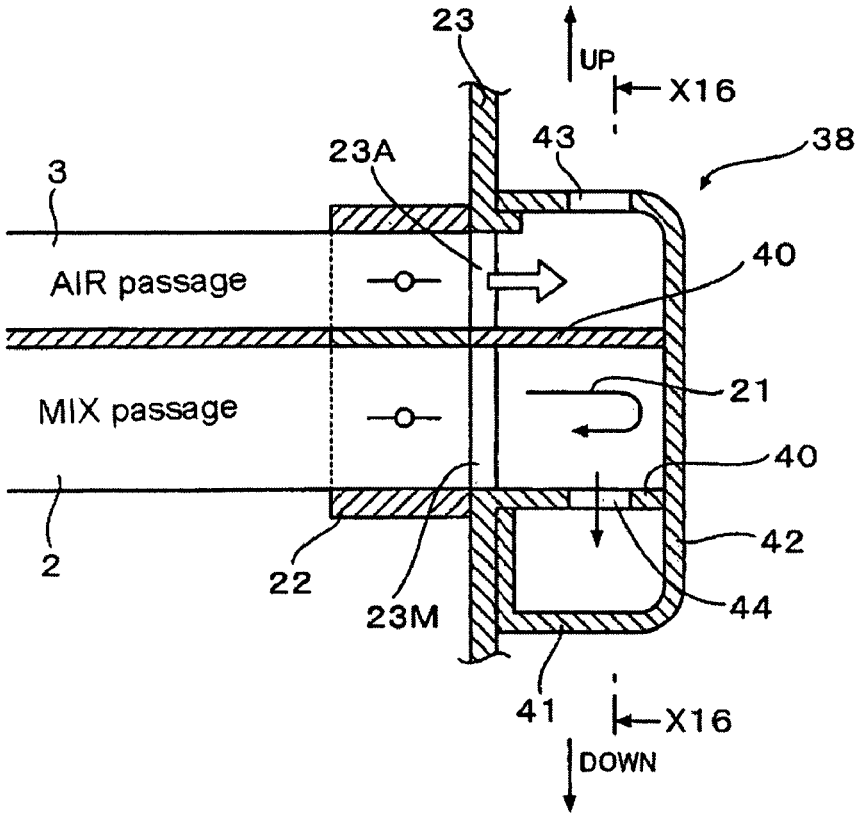
FIG. 15 is a schematic diagram of a yet further example of the present invention.
Figure 16:
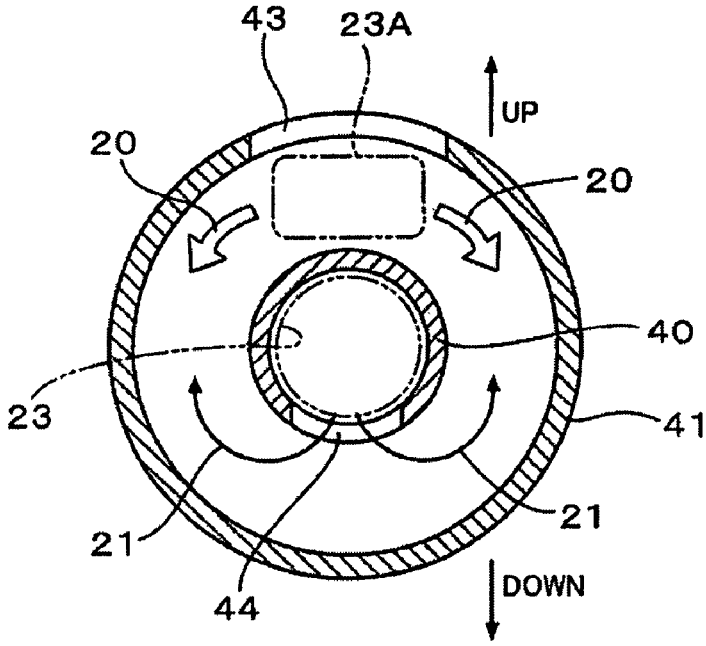
FIG. 16 is a cross-sectional view taken along the X16-X16 line of FIG. 15.
Figure 17:
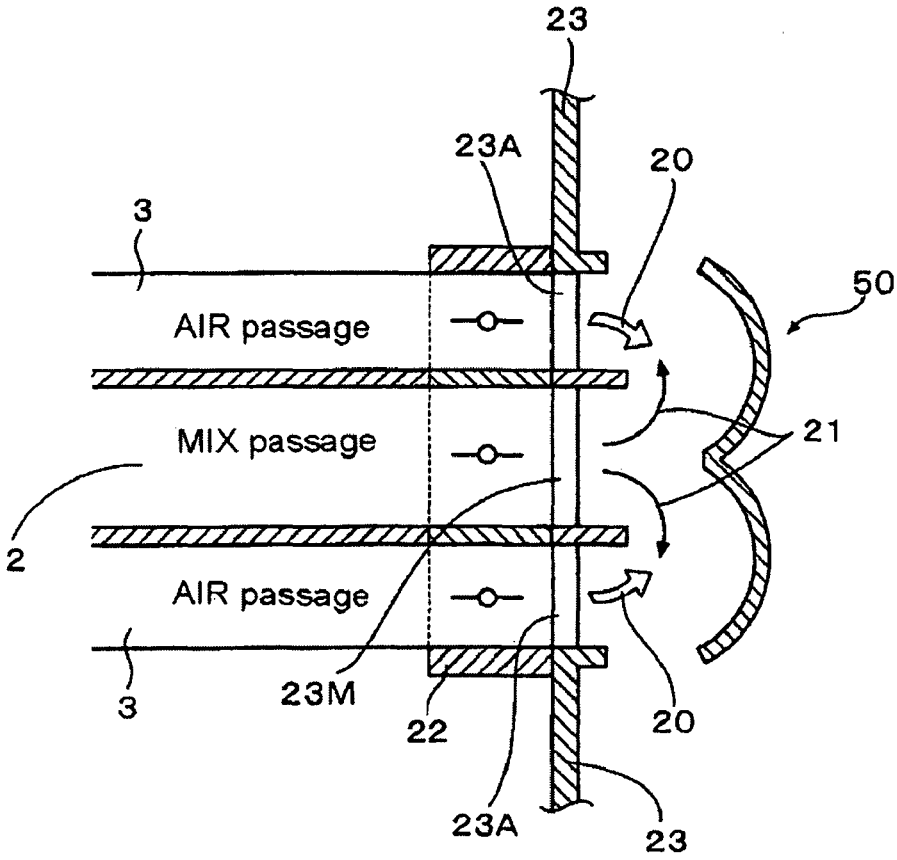
FIG. 17 is a diagram for explaining applicability of the present invention to an engine or air cleaner having a plurality of air passages or air openings.
Figure 18:
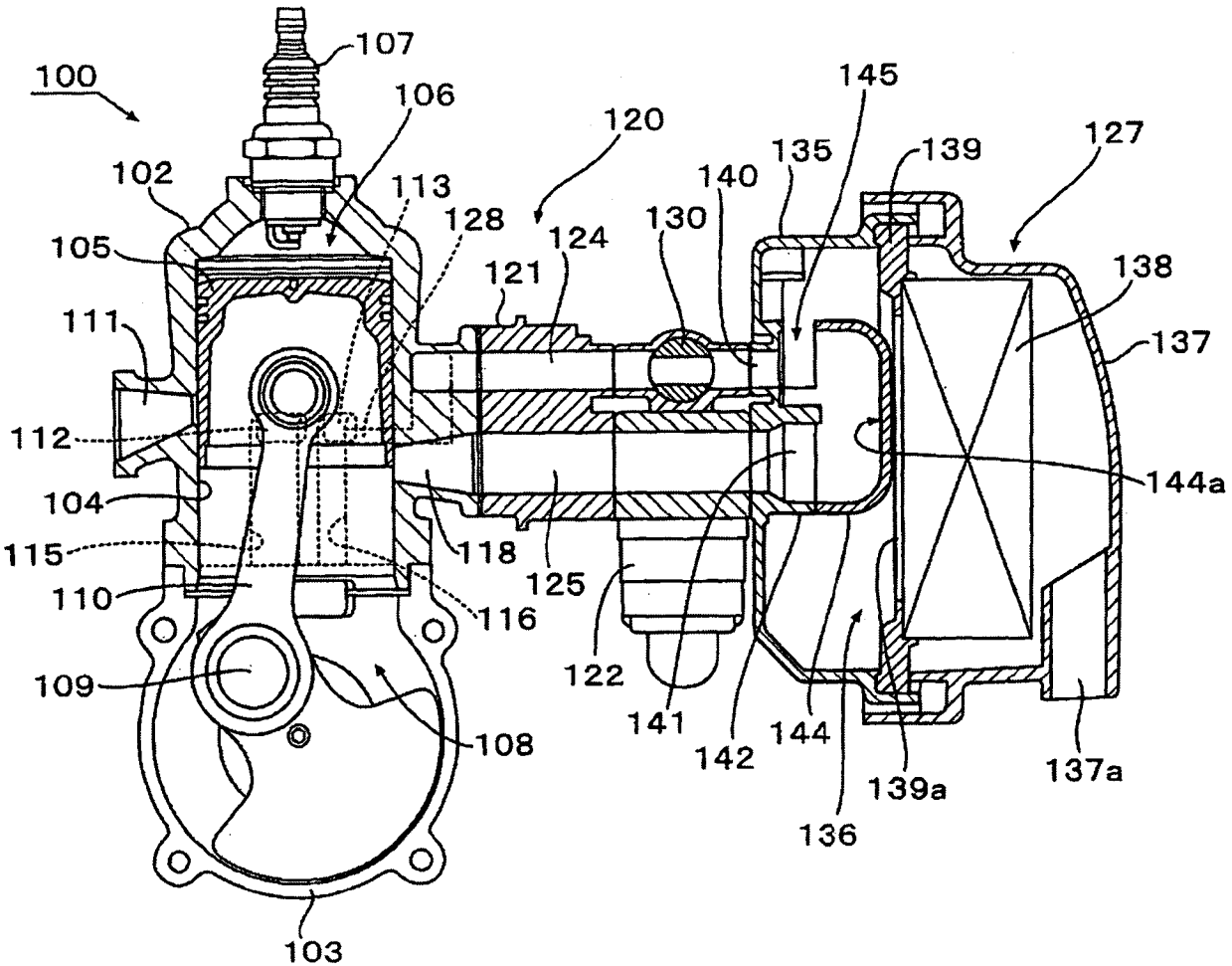
FIG. 18 is a vertical cross-sectional view of a two-stroke engine mounted with an air cleaner according to the first embodiment.
Figure 19:
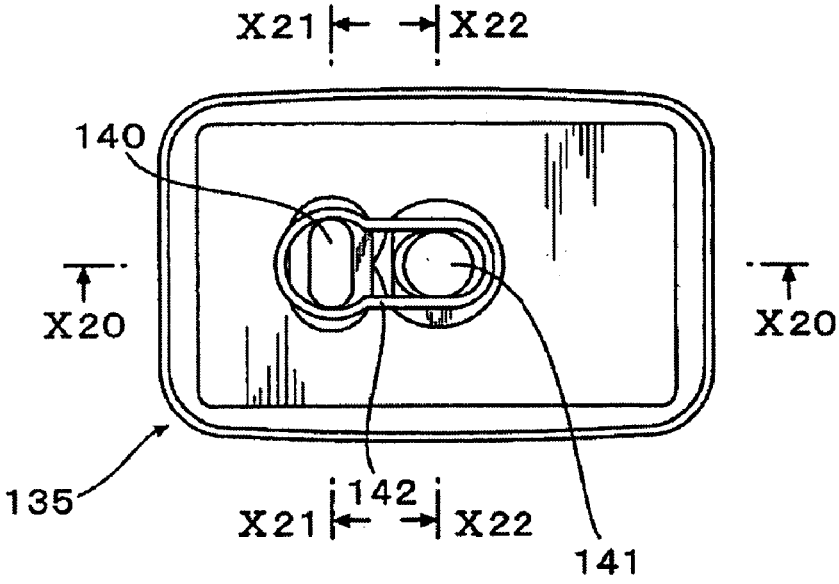
FIG. 19 is a plan view of an air cleaner base of the air cleaner.
Figure 20:
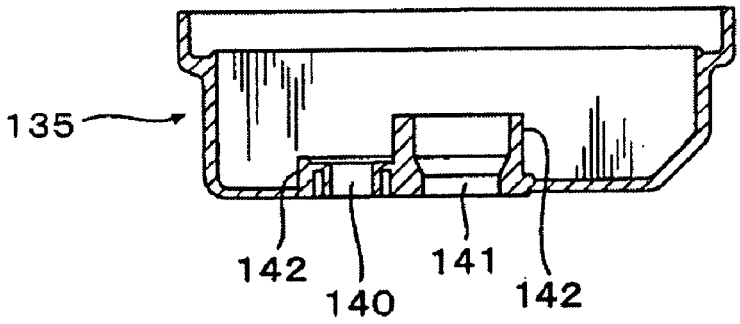
FIG. 20 is a cross-sectional view taken along the X20-X20 line of FIG. 19.
Figure 21:
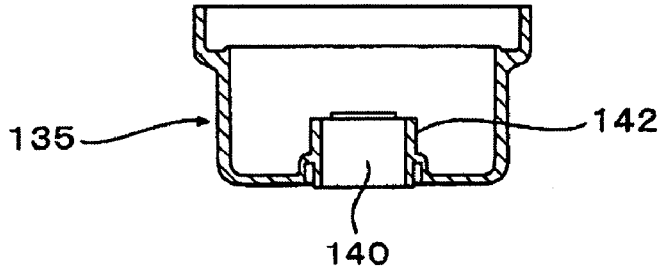
FIG. 21 is a cross-sectional view taken along the X21-X21 line of FIG. 19.
Figure 22:
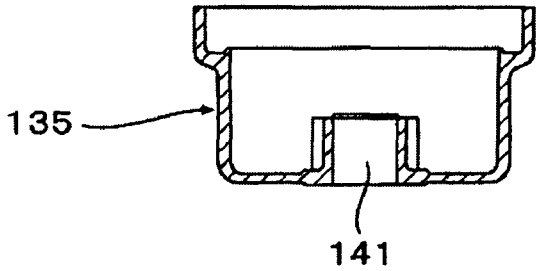
FIG. 22 is a cross-sectional view taken along the X22-X22 line of FIG. 19.
Figure 23:
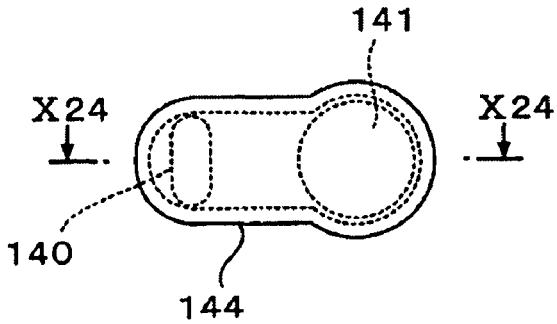
FIG. 23 is a plan view of an air cleaner base of the air cleaner according to the first embodiment.
Figure 24:
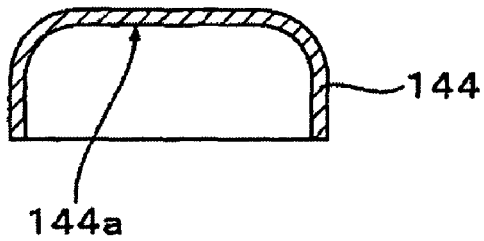
FIG. 24 is a cross-sectional view taken along the X24-X24 line of FIG. 23.
Figure 25:
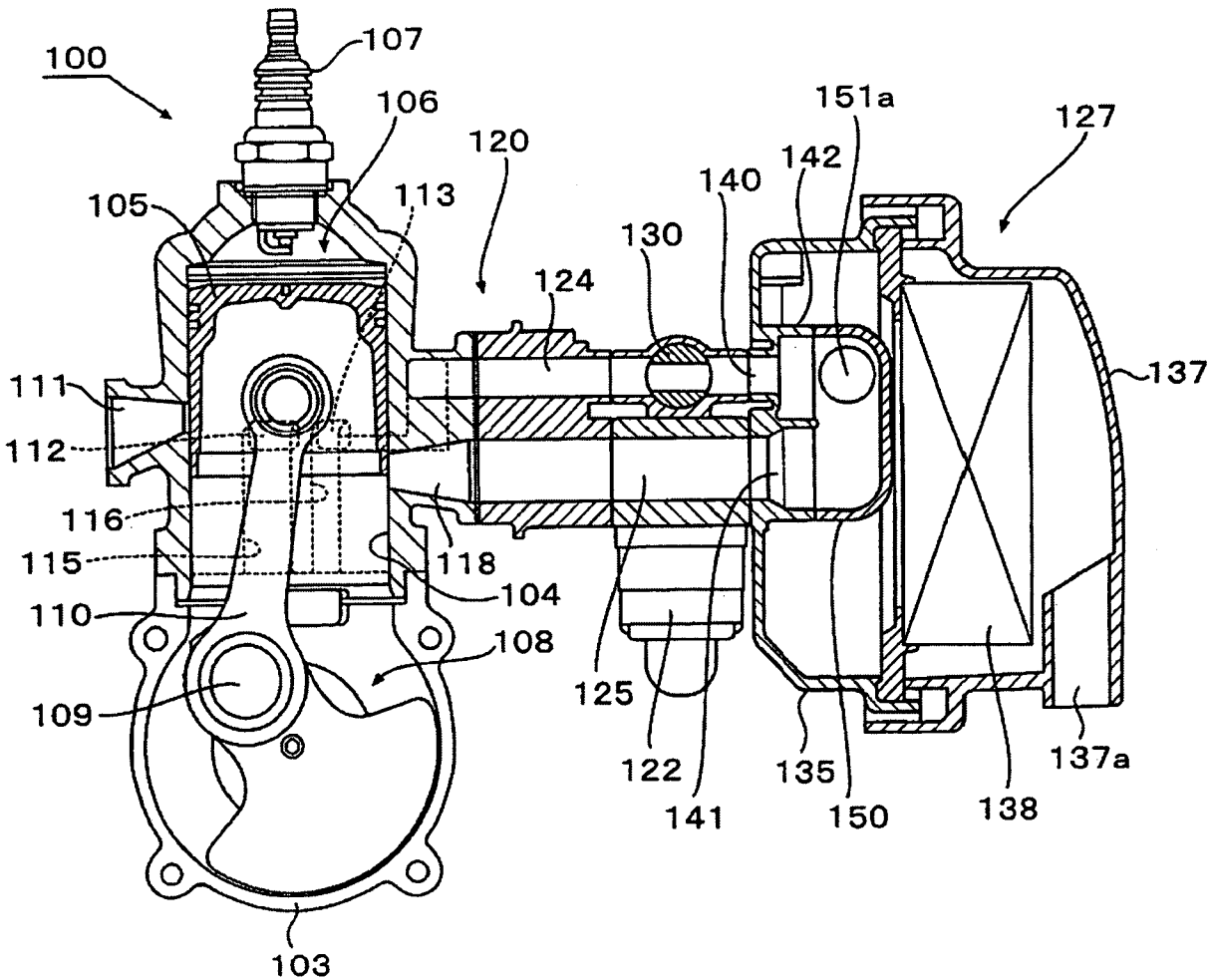
FIG. 25 is a vertical cross-sectional view of a two-stroke engine mounted with an air cleaner according to the second embodiment.
Figure 26:
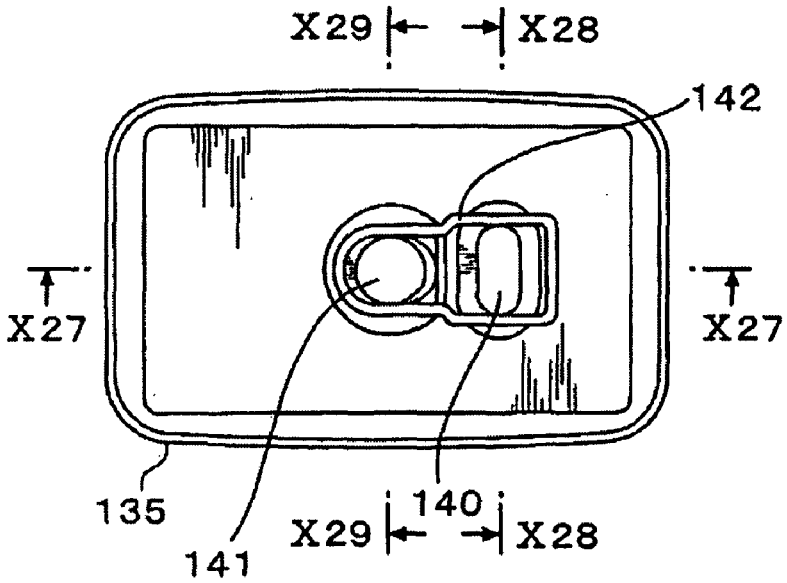
FIG. 26 is a plan view of an air cleaner base of the air cleaner according to the second embodiment.
Figure 27:
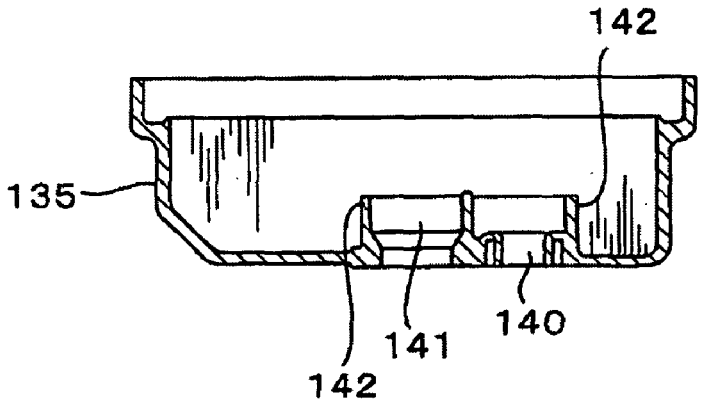
FIG. 27 is a cross-sectional view taken along the X27-X27 line of FIG. 26.
Figure 28:
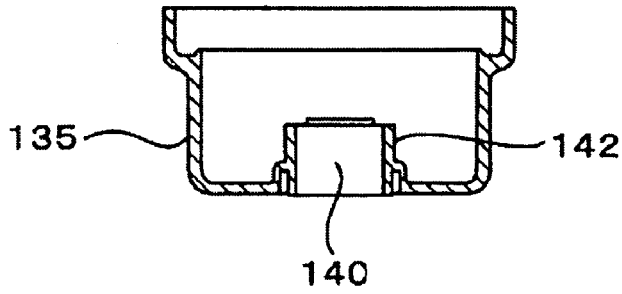
FIG. 28 is a cross-sectional view taken along the X28-X28 line of FIG. 26.
Figure 29:
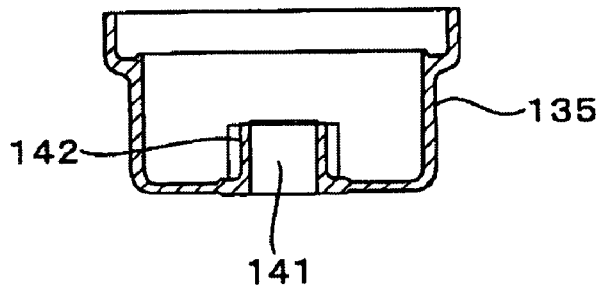
FIG. 29 is a cross-sectional view taken along the X29-X29 line of FIG. 26.
Figure 30:
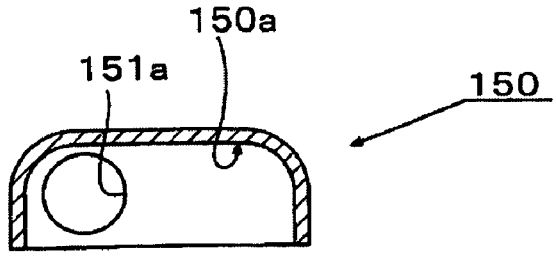
FIG. 30 is a cross-sectional view of a guide member employed in the air cleaner according to the second embodiment.
Figure 31:
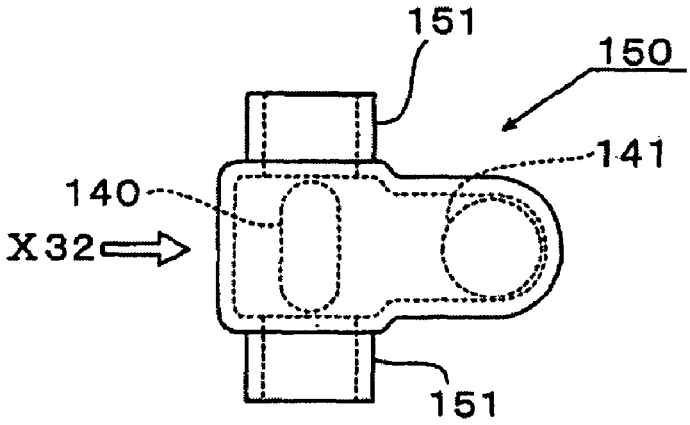
FIG. 31 is a plan view of the guide member of FIG. 30.
Figure 32:
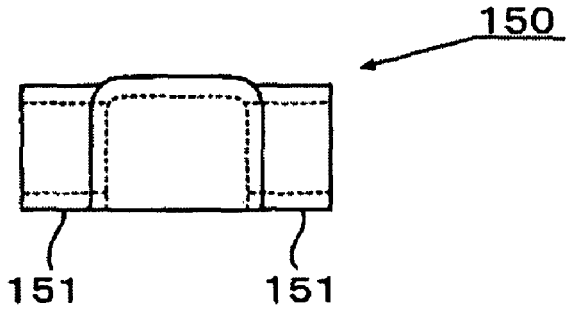
FIG. 32 is an end elevation of the guide member taken from the arrow X32 direction of FIG. 30.
Figure 33:
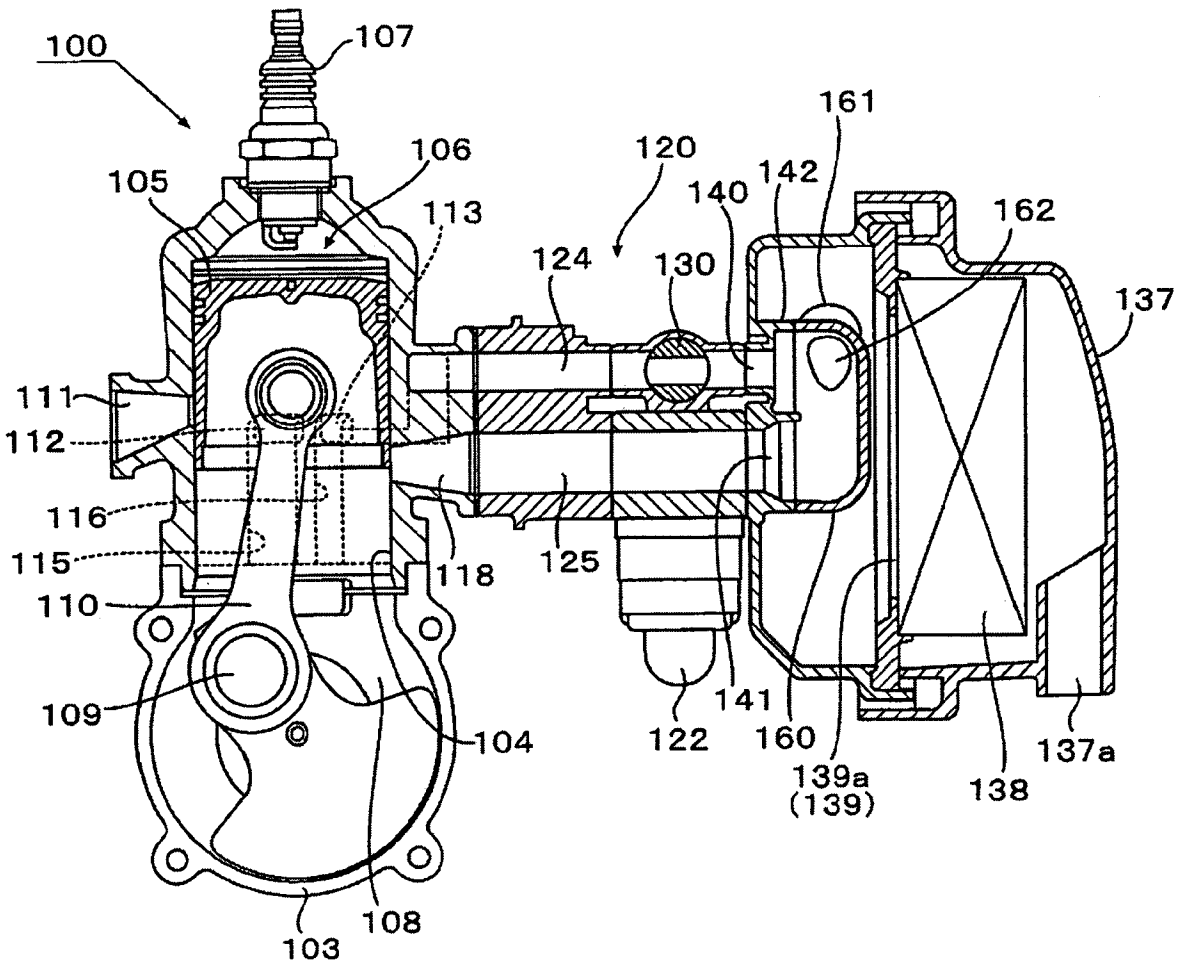
FIG. 33 is a vertical cross-sectional view of a two-stroke engine mounted with an air cleaner according to the third embodiment.
Figure 34:
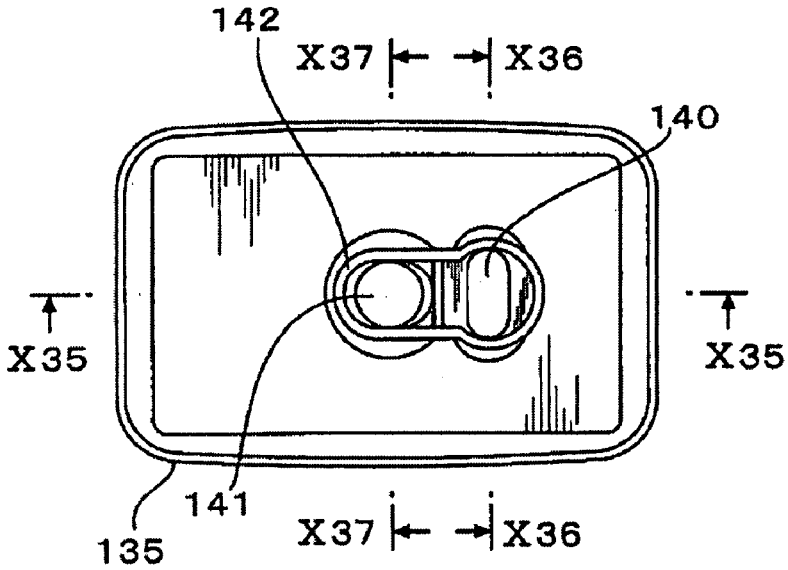
FIG. 34 is a plan view of an air cleaner base of the air cleaner according to the third embodiment.
Figure 35:
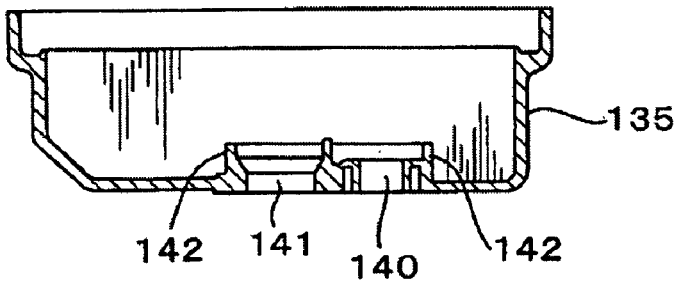
FIG. 35 is a cross-sectional view taken along the X35-X35 line of FIG. 34.
Figure 36:
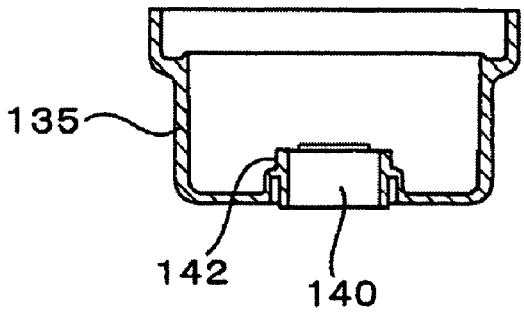
FIG. 36 is a cross-sectional view taken along the X36-X36 line of FIG. 34.
Figure 37:
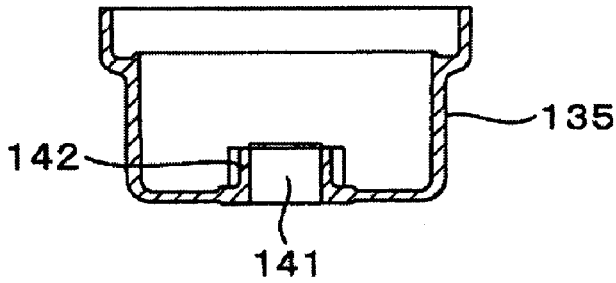
FIG. 37 is a cross-sectional view taken along the X37-X37 line of FIG. 34.
Figure 38:
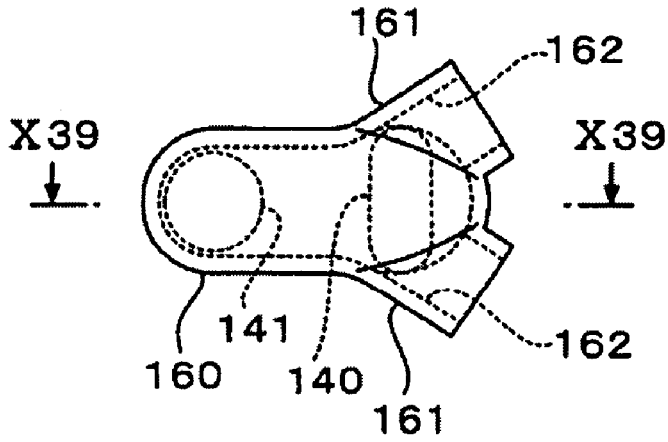
FIG. 38 is a cross-sectional view of a guide member employed in the air cleaner according to the third embodiment.
Figure 39:
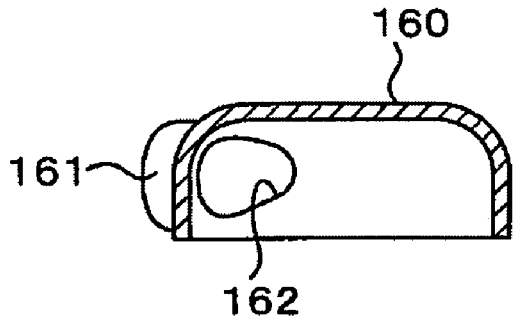
FIG. 39 is a cross-sectional view taken along the X39-X39 line of FIG. 38.
Figure 40:
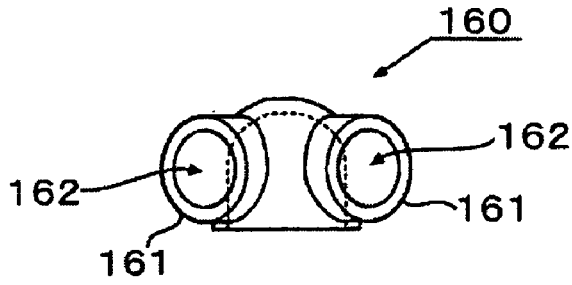
FIG. 40 is an end elevation of the guide member of FIG. 38.
Figure 41:
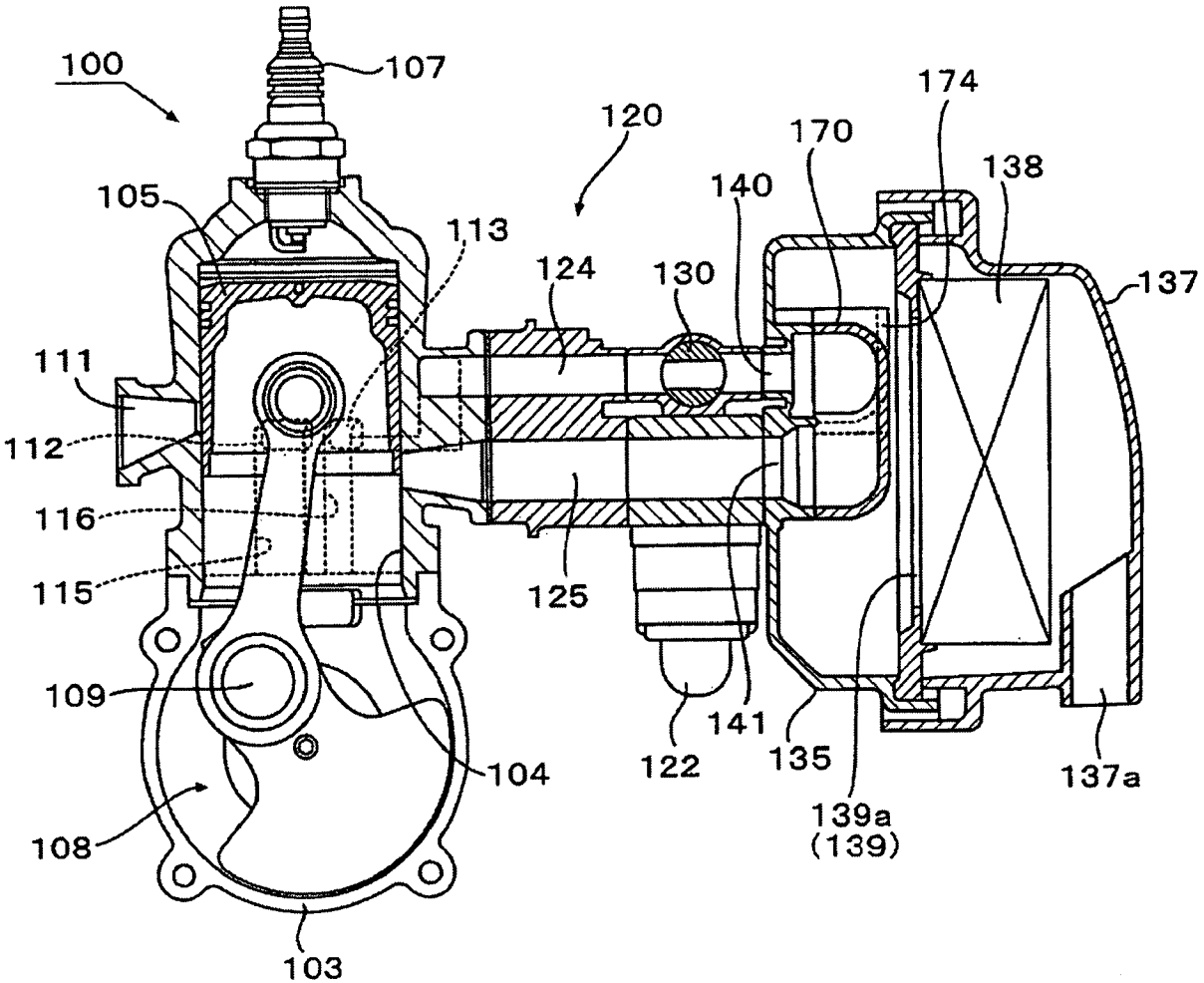
FIG. 41 is a vertical cross-sectional view of a two-stroke engine mounted with an air cleaner according to the fourth embodiment.
Figure 42:
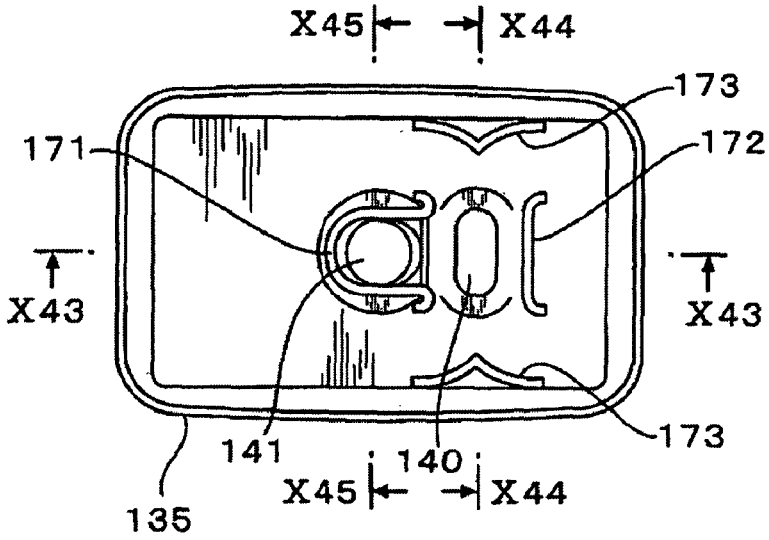
FIG. 42 is a plan view of an air cleaner base of the air cleaner according to the fourth embodiment.
Figure 43:
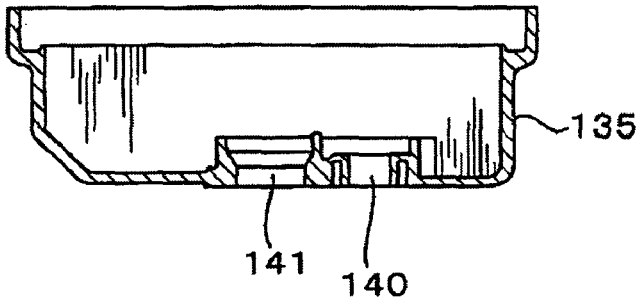
FIG. 43 is a cross-sectional view taken along the X43-X43 line of FIG. 42.
Figure 44:
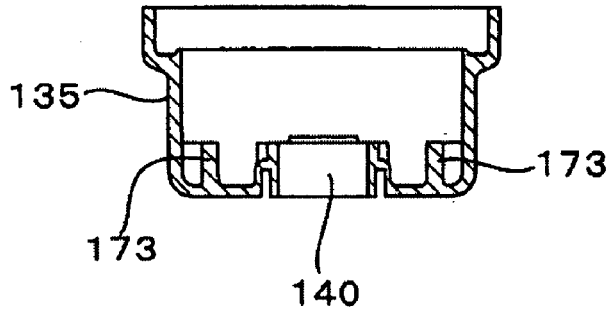
FIG. 44 is a cross-sectional view taken along the X44-X44 line of FIG. 42.
Figure 45:
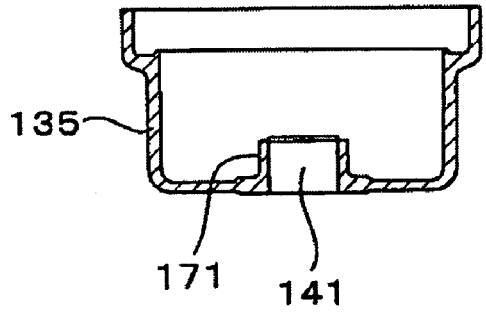
FIG. 45 is a cross-sectional view taken along the X45-X45 line of FIG. 42.
Figure 46:
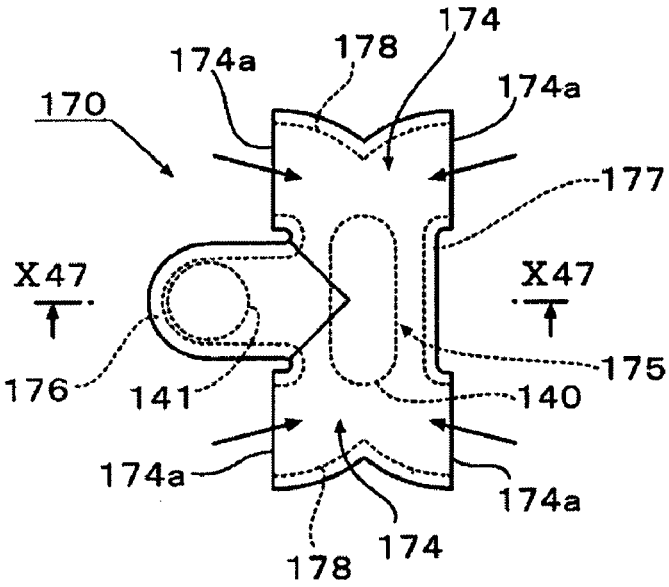
FIG. 46 is a plan view of a guide member used in the air cleaner according to the fourth embodiment.
Figure 47:
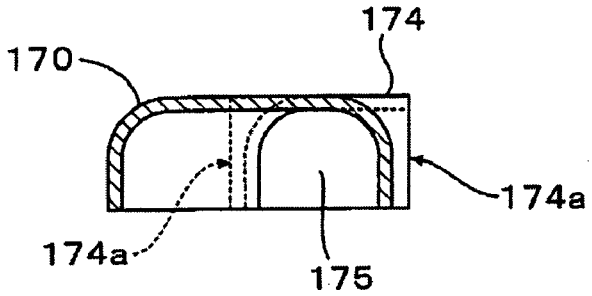
FIG. 47 is a cross-sectional view taken along the X47-X47 line of FIG. 46.
Figure 48:
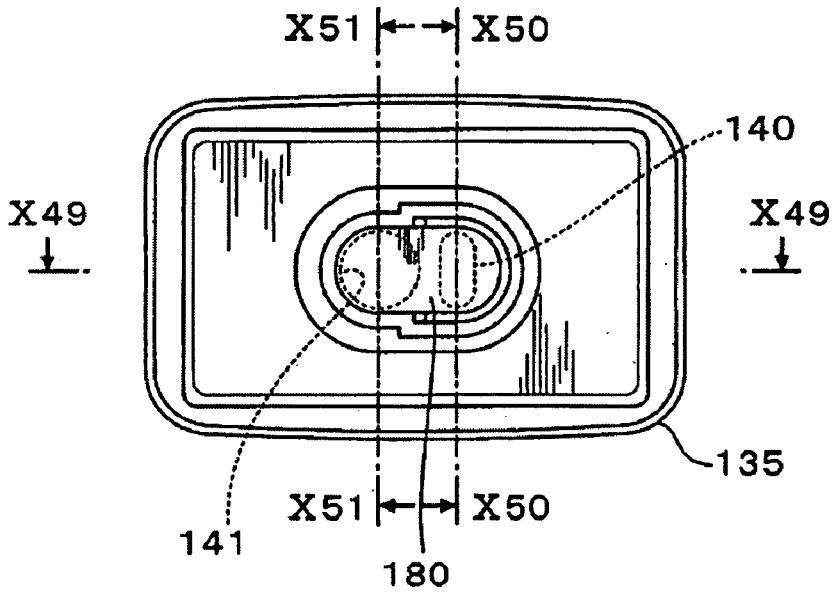
FIG. 48 is a plan view of a guide member used in an air cleaner according to the fifth embodiment.
Figure 49:
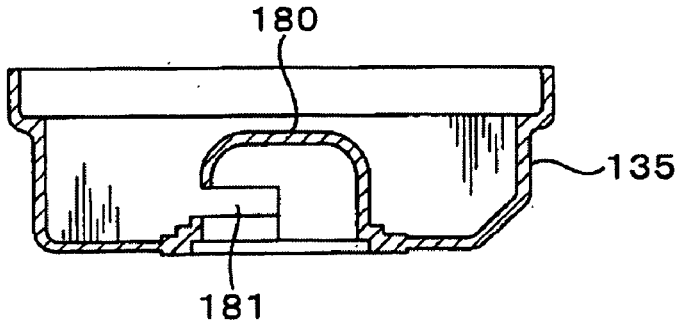
FIG. 49 is a cross-sectional view taken along the X49-X49 line of FIG. 48.
Figure 50:
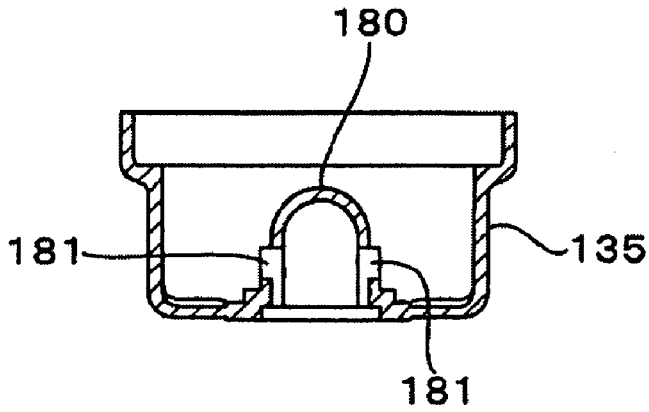
FIG. 50 is a cross-sectional view taken along the X50-X50 line of FIG. 48.
Figure 51:
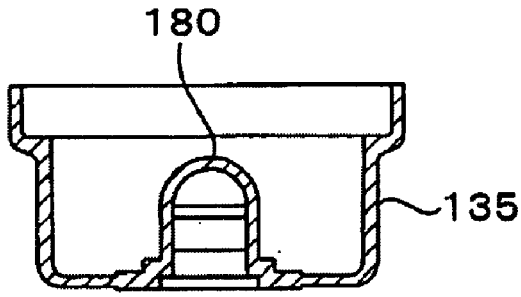
FIG. 51 is a cross-sectional view taken along the X51-X51 line of FIG. 48.
Figure 52:
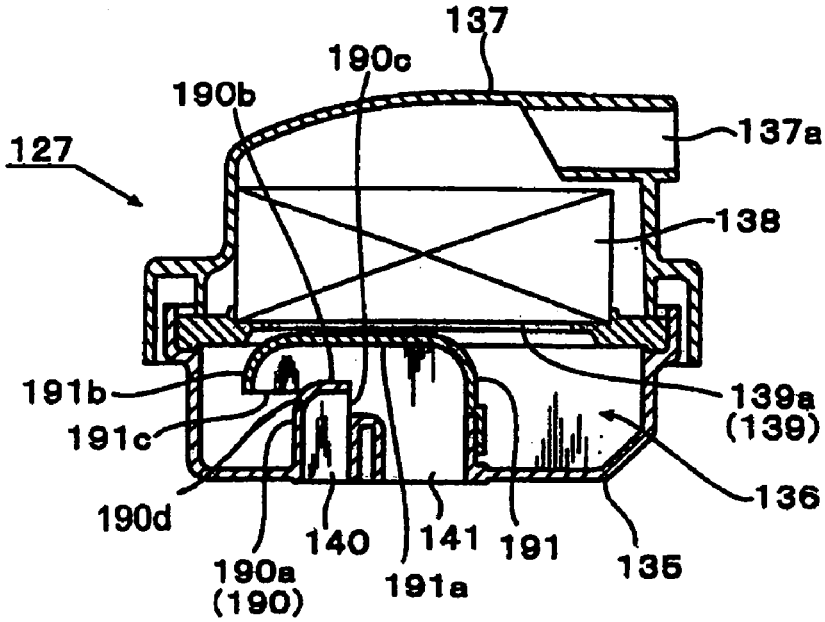
FIG. 52 is a cross-sectional view of an air cleaner according to the sixth embodiment.
Figure 53:
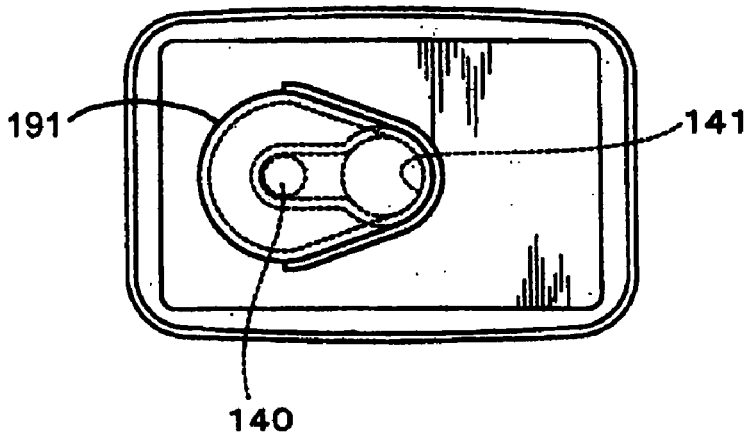
FIG. 53 is a plan view of an air cleaner base contained in the air cleaner according to the sixth embodiment.
Figure 54:
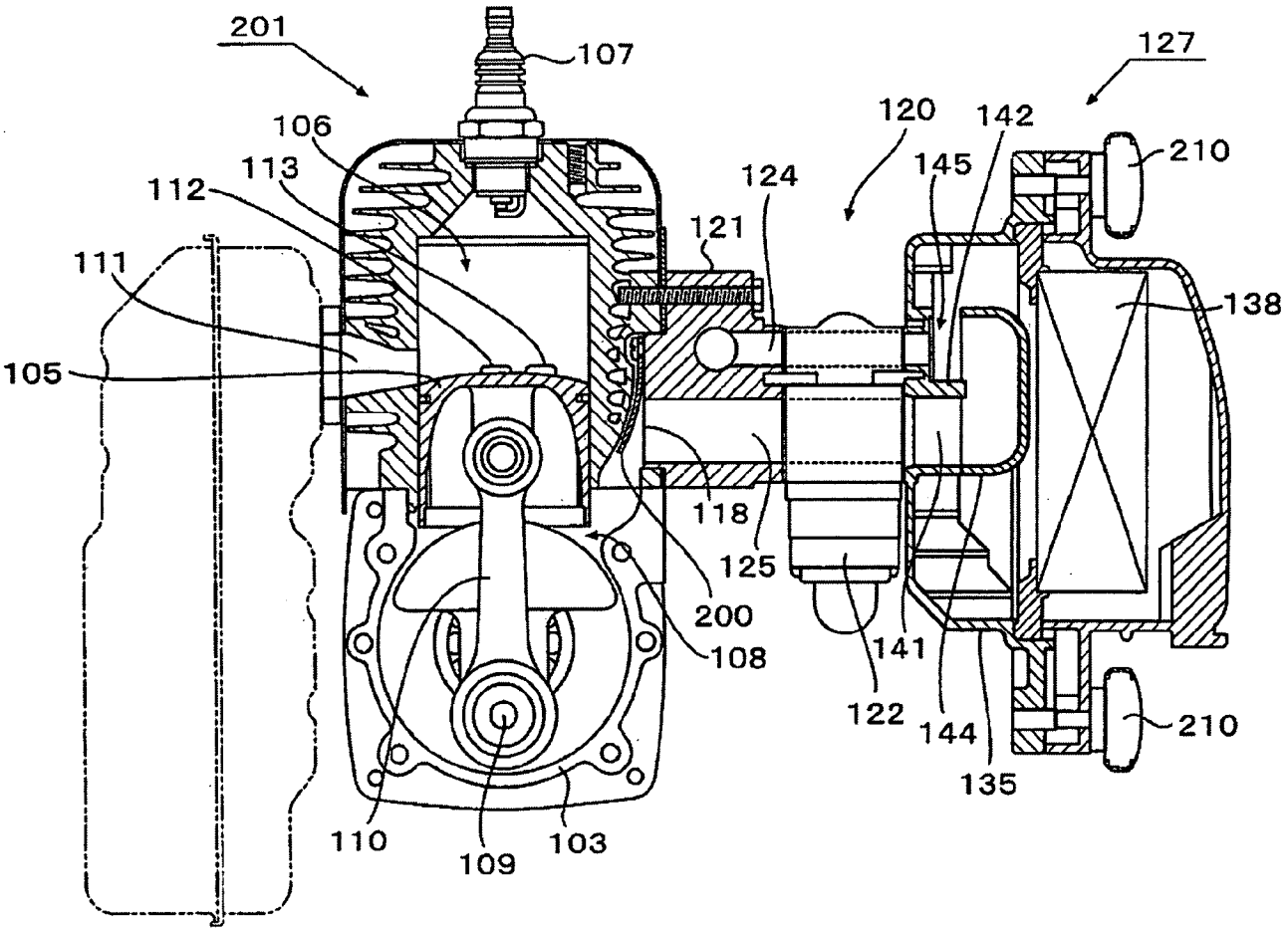
FIG. 54 is a vertical cross-sectional view of a two-stroke engine mounted with an air cleaner according to the seventh embodiment.
Figure 55:
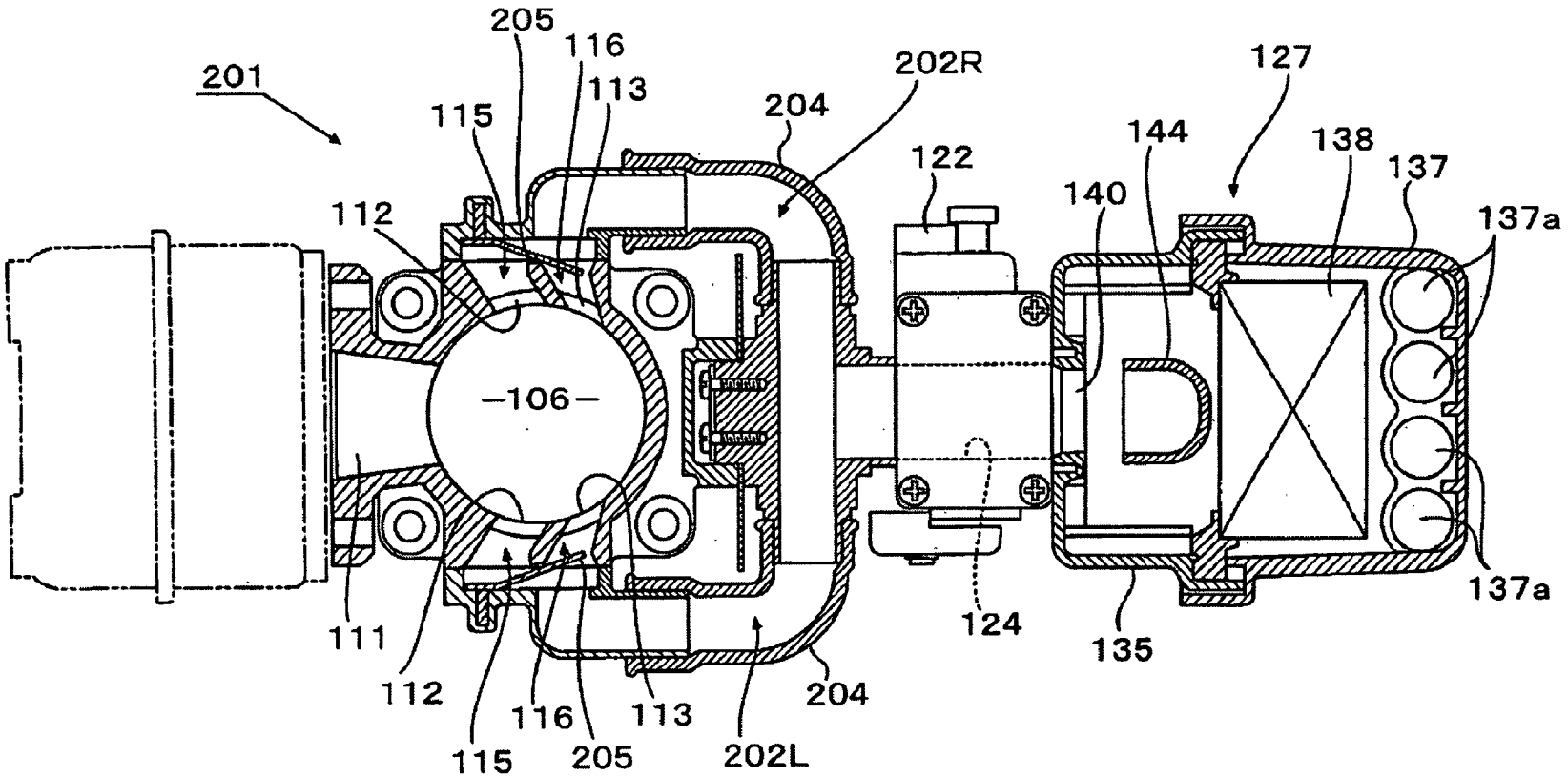
FIG. 55 is a transverse cross-sectional view of the two-stroke engine of FIG. 54.
Figure 56:
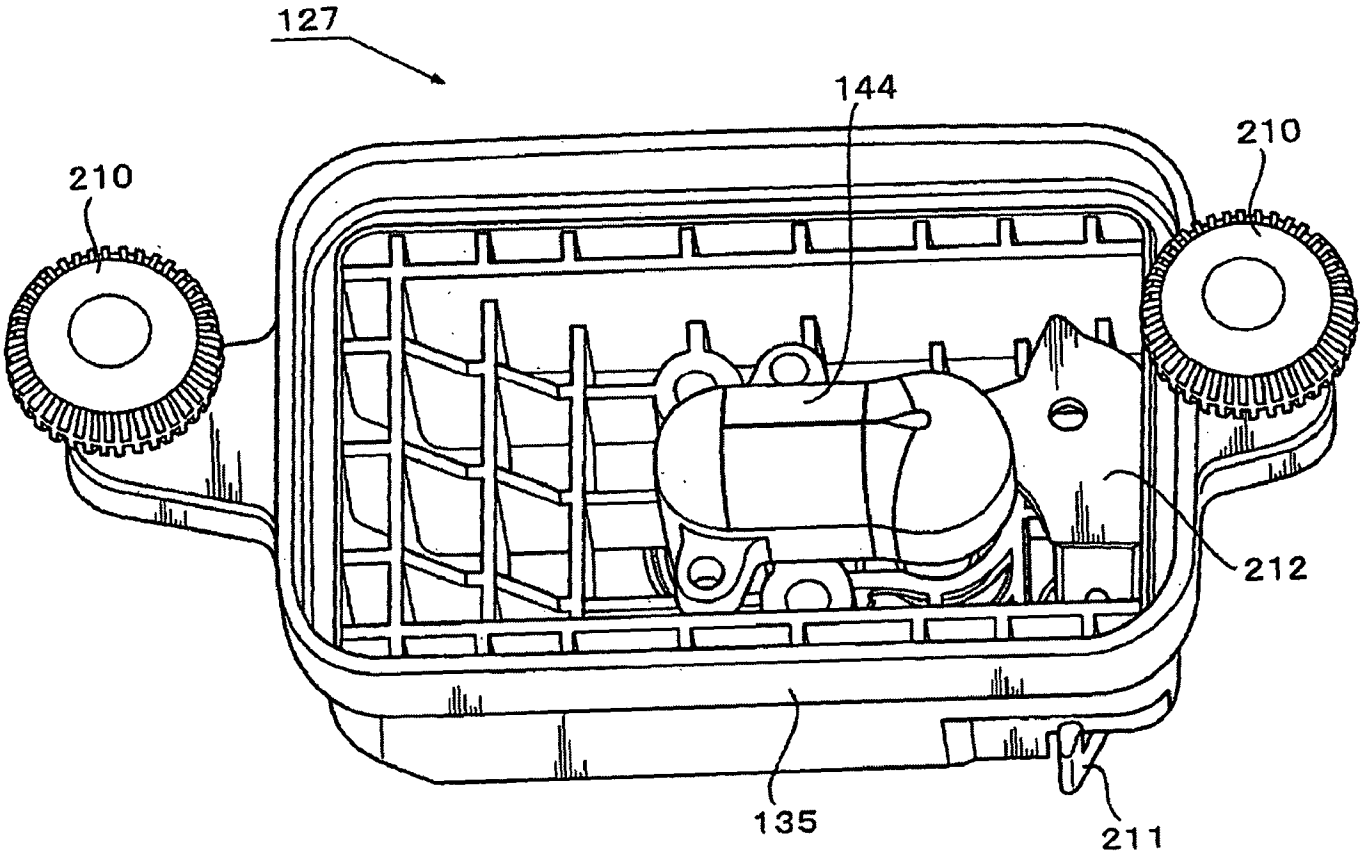
FIG. 56 is a perspective view of the air cleaner according to the seventh embodiment, with its outer cover being removed.
Figure 57:
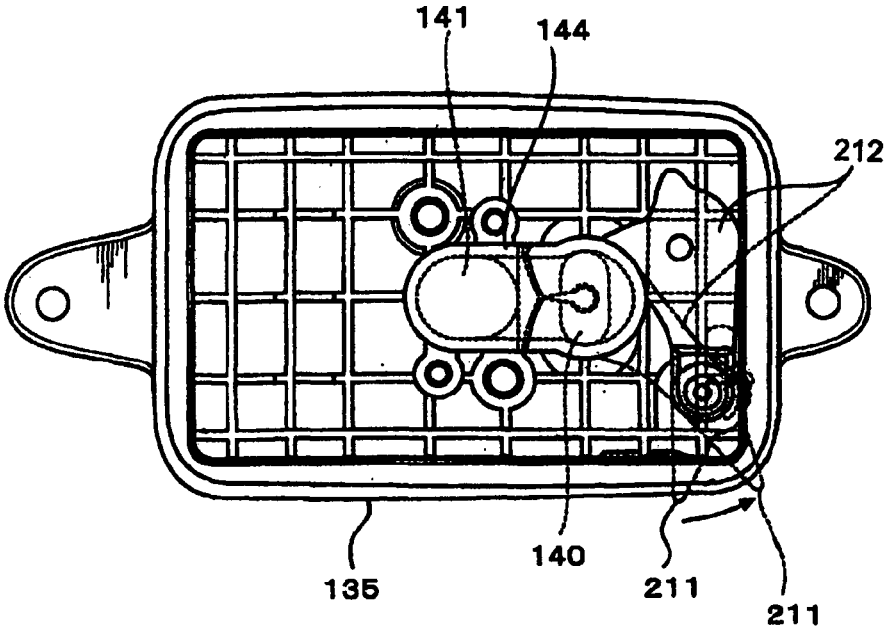
FIG. 57 is a plan view of an air cleaner base of the air cleaner according to the seventh embodiment, with a guide member attached to the air cleaner base.
Figure 58:
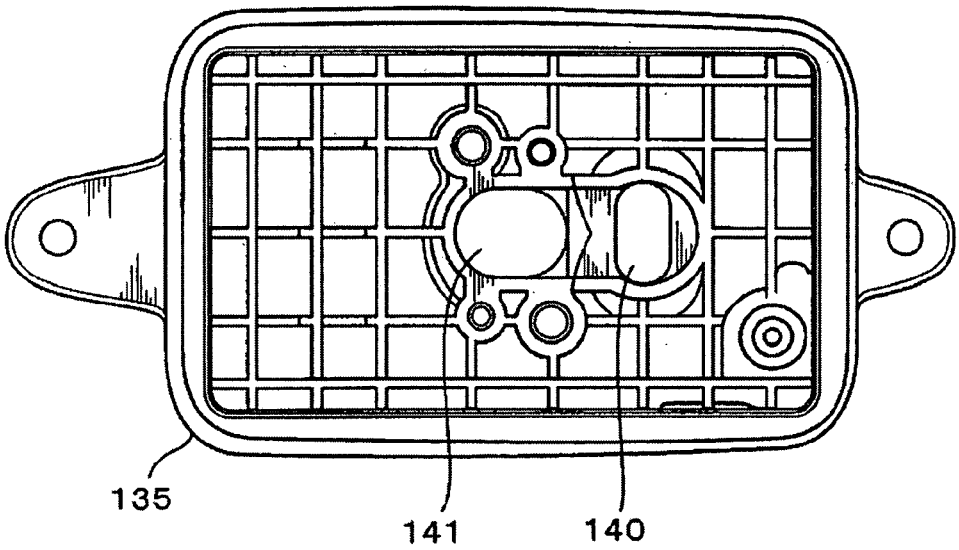
FIG. 58 is a plan view corresponding to FIG. 57, in which the guide member has been removed.
Figure 59:
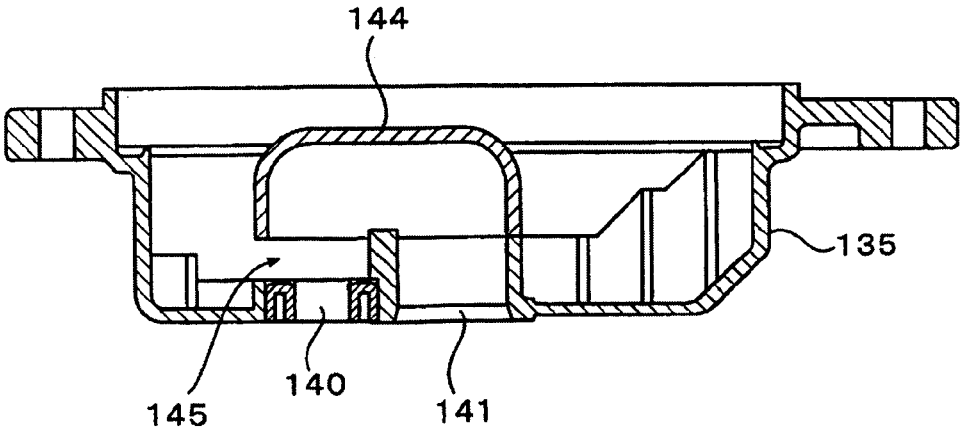
FIG. 59 is a vertical cross-sectional view of the air cleaner base shown in FIG. 57.
Figure 60:
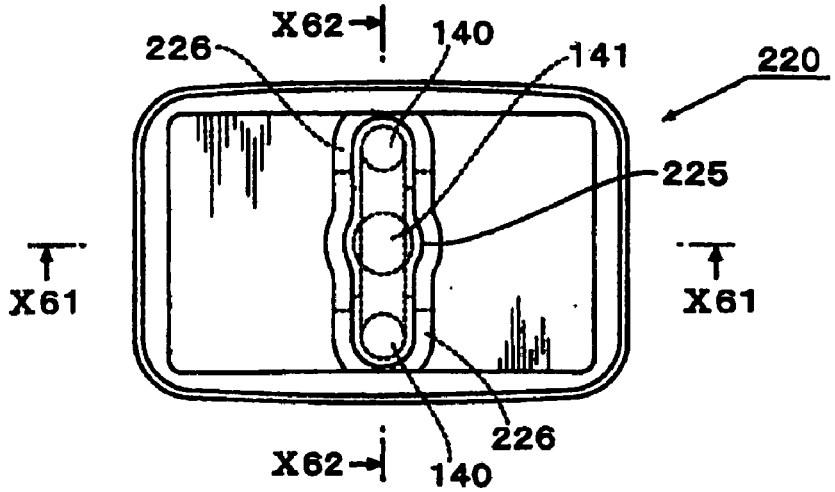
FIG. 60 is a plan view of an air cleaner base of an air cleaner according to the eighth embodiment.
Figure 61:
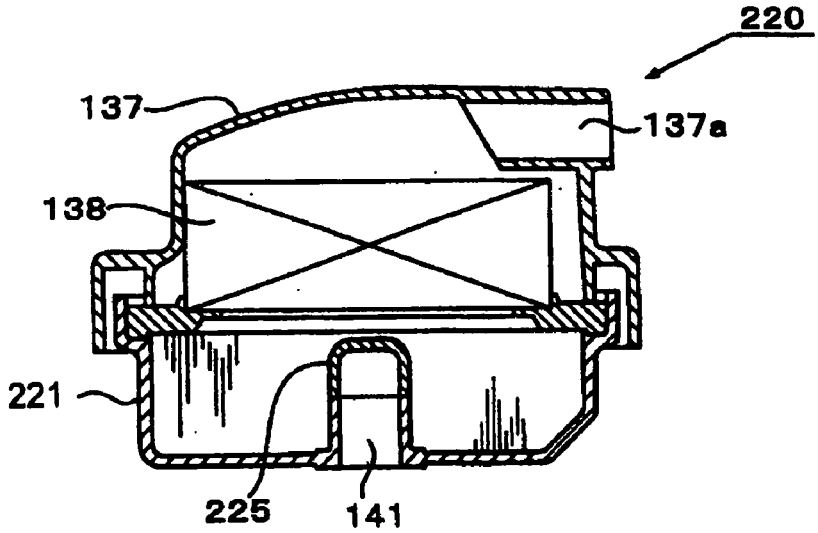
FIG. 61 is a cross-sectional view taken along the X61-X61 line of FIG. 60.
Figure 62:
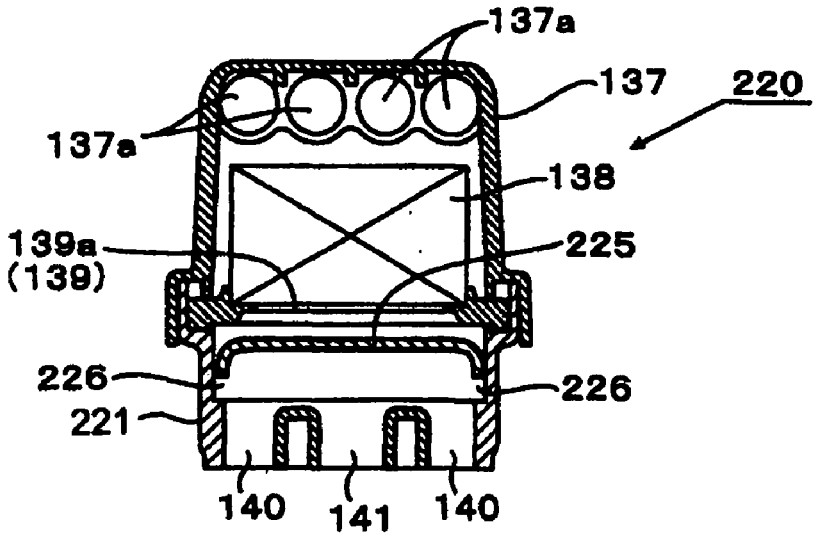
FIG. 62 is a cross-sectional view taken along the X62-X62 line of FIG. 60.
Figure 63:
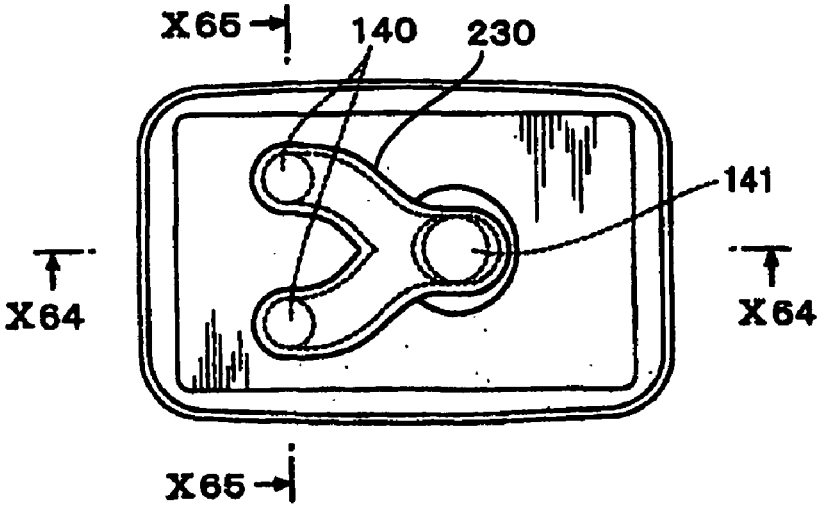
FIG. 63 is a plan view of an air cleaner base of an air cleaner according to the ninth embodiment.
Figure 64:
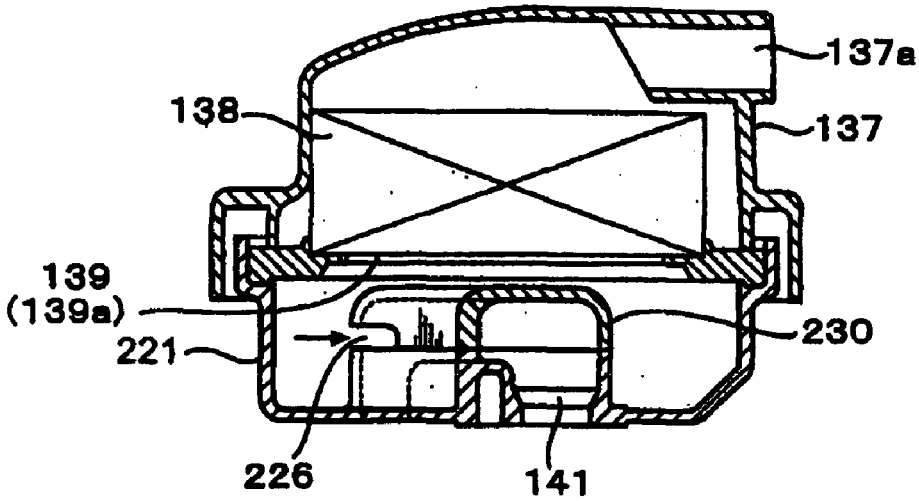
FIG. 64 is a cross-sectional view taken along the X64-X64 line of FIG. 63.
Figure 65:
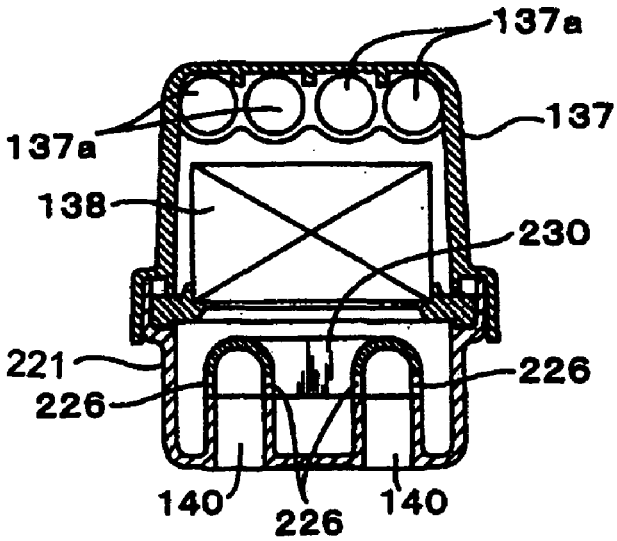
FIG. 65 is a cross-sectional view taken along the X65-X65 line of FIG. 63.
Figure 66:
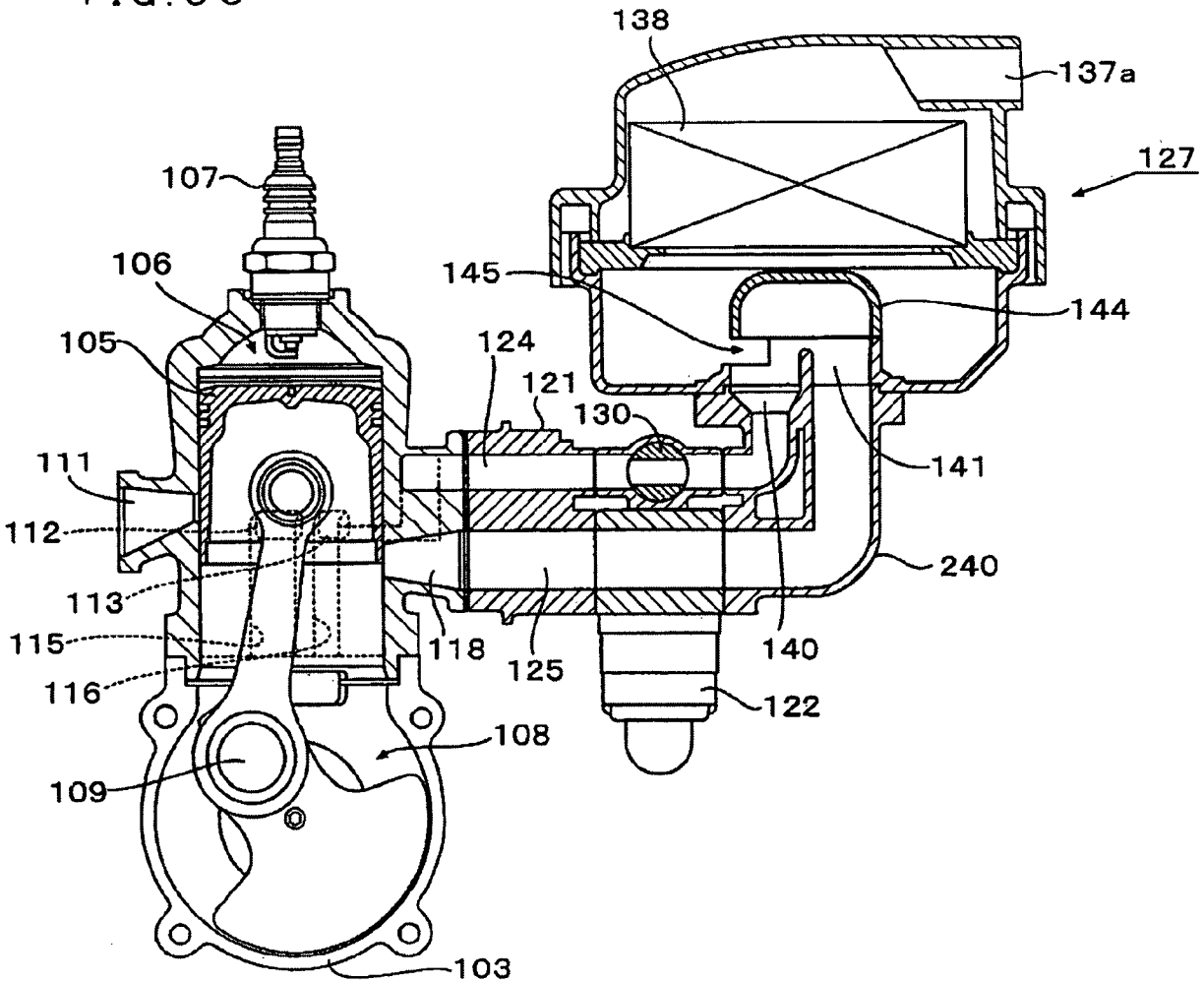
FIG. 66 is a diagram for explaining a modified method of attaching the air cleaner as the tenth embodiment.

100 Two-stroke engine
104 Cylinder
105 Piston
106 Combustion chamber
107 Ignition plug
108 Crank chamber
111 Exhaust port
112 First scavenging window
113 Second scavenging window
115 First scavenging channel
116 Second scavenging channel
118 Air-fuel mixture port
120 Intake system
122 Carburetor
124 Air passage
125 Air-fuel mixture passage
127 Air cleaner
135 Air cleaner base
136 Air cleaner chamber
137 Outer case
138 Air cleaner element
140 First air opening
141 Second air opening
144 Guide member
145 Air induction opening

The invention claimed is:

1. An air cleaner to be removably attached to a stratified-scavenging two-stroke internal combustion gasoline engine having:

a scavenging window formed into an inner wall of a cylinder;

a scavenging channel making communication between said scavenging window and a crank chamber;

an exhaust port formed into the inner wall of the cylinder;

an air passage communicating with said scavenging channel and feeding the scavenging channel with fuel-free air; and an air-fuel mixture passage for feeding the crank chamber with air-fuel mixture, wherein the air-fuel mixture in said crank chamber is pre-compressed by a descending movement of a piston in an expansion stroke thereof, and the fuel-free air is forced into a combustion chamber through said scavenging window in a scavenging stroke to stratified-scavenge the combustion chamber, wherein the air cleaner comprises:

an air cleaner element for cleaning air;

a first air opening for supplying said air passage of the engine with air cleaned by said air cleaner element;

a second air opening for supplying said air-fuel mixture passage of the engine with air cleaned by said air cleaner element: and a guide member for guiding a back-flow of the fuel-free air toward a vicinity of the second air opening, said back flow of the fuel-free air flowing back into the cleaner through said first air opening after a back flow of the air-fuel mixture flows back into the cleaner through said second air opening during normal operation of the engine, and said back flow of the fuel-free air guided toward the vicinity of the second air opening acting to detain the back flow of the air-fuel mixture once entering into the cleaner element near the second air opening until said back flow of the air-fuel mixture returns into the air-fuel mixture passage through the second air opening.

2. The air cleaner according to claim 1 wherein the guide member has a bouncing plane for bounding the air-fuel mixture rushing out of the second air opening toward the second air opening and has an air guide plane for directing the fuel-free air rushing out of the first air opening to a vicinity of the second air opening.

3. The air cleaner according to claim 1 wherein said guide member has an air-fuel mixture guide plane for directing the air-fuel mixture rushing out of the second air opening to a vicinity of the second air opening and has an air guide plane for directing the fuel-free air rushing out of the first air opening to a vicinity of the second air opening.

4. The air cleaner according to claim 1 wherein said guide member comprises an interconnection member that makes communication between the first air opening and the second air opening in a closed space, and wherein the interconnection member has an air induction opening formed near the first air opening to induce air cleaned by the air cleaner element into an inner space of the interconnection member.

5. The air cleaner according to claim 4 wherein the interconnection member includes an air induction tube extending from a sidewall thereof near the first air opening, and wherein the air induction tube defines an air induction channel for supplying the air cleaned by the air cleaner element into the inner space of the interconnection member.

6. The air cleaner according to claim 4 wherein the interconnection member includes an air inducing portion formed near the first air opening to induce the air cleaned by the air cleaner element into the inner space of the interconnection member, and wherein a plurality of said air induction openings are formed in said air inducing portion.

7. The air cleaner according to claim 4 wherein the interconnection member is removably attached to the air cleaner.

8. The air cleaner according to claim 1 wherein said scavenging window comprises a first scavenging window nearer to the exhaust port and a second scavenging window remoter from the exhaust port, and wherein fuel-free air is forced into the combustion chamber through said second scavenging window.

9. The air cleaner according to claim 1 wherein said scavenging window comprises a first scavenging window nearer to the exhaust port and a second scavenging window remoter from the exhaust port, and wherein fuel-free air is forced into the combustion chamber through said first scavenging window.

* * * * *